US006070389A

United States Patent [19]

Irvin

[11] Patent Number: 6,070,389

[45] Date of Patent: Jun. 6, 2000

[54] APPARATUS AND METHOD FOR WRAPPING ARTICLES

[76] Inventor: John M. Irvin, 2258 Ashwood La., Highlands Ranch, Colo. 80126

[21] Appl. No.: 08/967,376

[22] Filed: Nov. 8, 1997

[51] Int. Cl.[7] ..... B65B 11/08

[52] U.S. Cl. ..... 53/397; 53/466; 53/228; 53/544; 53/580; 53/586; 53/389.3

[58] Field of Search ..... 53/397, 399, 466, 53/580, 586, 228, 230, 389.3, 544, 520; 83/697

[56] References Cited

U.S. PATENT DOCUMENTS

| | | | |
|---|---|---|---|
| 15,163 | 6/1856 | Arnold | 83/697 |
| 2,860,462 | 11/1958 | Sykes | 53/580 X |
| 2,994,998 | 8/1961 | Zuercher | 53/580 |
| 3,680,610 | 8/1972 | Lindgren . | |
| 3,716,960 | 2/1973 | Wright et al. . | |
| 4,329,896 | 5/1982 | Singer . | |
| 4,531,343 | 7/1985 | Wood . | |
| 4,726,172 | 2/1988 | Widenbäck . | |
| 4,852,442 | 8/1989 | Pottorff . | |
| 4,991,376 | 2/1991 | Backman . | |
| 4,993,209 | 2/1991 | Haloila . | |
| 5,009,055 | 4/1991 | Simmons . | |
| 5,216,873 | 6/1993 | Ratzlaff et al. . | |
| 5,218,813 | 6/1993 | Siedel . | |
| 5,259,167 | 11/1993 | Underhill et al. . | |
| 5,274,983 | 1/1994 | Sjogren et al. | 53/399 |
| 5,317,859 | 6/1994 | Schneider et al. | 53/544 X |
| 5,319,899 | 6/1994 | Jennings et al. . | |
| 5,375,496 | 12/1994 | Peru et al. . | |
| 5,447,008 | 9/1995 | Martin-Cocher . | |
| 5,448,873 | 9/1995 | Jennings et al. . | |
| 5,636,496 | 6/1997 | Pietiläet et al. . | |

*Primary Examiner*—Linda Johnson
*Attorney, Agent, or Firm*—Jennifer S. Stachniak

[57] ABSTRACT

An apparatus for wrapping articles, such as bundles of newspapers, on one or three sides is disclosed. The apparatus comprises a conveyor means, a paper guide and dispensing means for conveying a sheet of paper dispensed from a roll into the path of a bundle moving along the conveyor, a wrapping means for covering the bundle with paper on one or three sides, and a reciprocating, double-edged cutting means for cutting the desired length of paper from the roll. The three-way wrap assembly includes a pair of paper support means, preferably C-shaped flexible belts which contact the paper lightly at three points, allowing the paper to maintain a substantially vertical orientation relative to the path of the bundle during the wrapping operation. In the preferred embodiment, the apparatus includes an integrated bundle turner assembly for lifting and turning a bundle 90 degrees relative to its original path of travel. The apparatus may include a printing means, such as an ink jet assembly, mounted above the cutting means.

25 Claims, 15 Drawing Sheets

APPARATUS AND METHOD FOR WRAPPING ARTICLES

BACKGROUND OF THE INVENTION

1. Field of the Invention

The present invention relates generally to apparatus and methods for wrapping articles, particularly bundles of newspapers, and more specifically, relates to an apparatus with an integrated bundleturner for bottom-wrapping or three-sided wrapping of bundles, and a method for wrapping bundles.

2. Description of the Prior Art

It is common in the printing and publishing industries to bundle and tie together stacks of newspapers or other publications to aid in shipping, transport, and storage. Typically, it is desirable that these bundles be wrapped or otherwise covered for protection, often by simply inserting a length of paper under the bottom surface of the bundle, known as bottom-wrapping, or by covering the bundle on three sides, known as three-way wrapping, which better protects the bundle from wetness or soiling. Bottomwrapping and three-way wrapping machines have been devised which dispense a pre-fed sheet of durable paper of predetermined length from a roll of paper. However, generally such machines are capable of performing only a single type of wrapping technique, that is, either bottomwrapping or three-way wrapping, or require an attachment or accessory to allow the machine to perform both functions. Most wrapping machines require that the paper web be upwardly fed, often through a paper guide assembly and then maintained in that vertical orientation generally in the path of the bundle, either by gripping the upper end of the paper web or by creasing or otherwise manipulating the paper to allow it to stand upright and not fold down upon itself.

For instance, U.S. Pat. No. 5,274,983 to Sjogren et al discloses an apparatus for wrapping a bundle, but requires that the wrapping sheet be shaped in a predetermined manner, preferably by creasing, to provide sufficient rigidity to permit the sheet to be self-supporting. U.S. Pat. No. 5,009,055 to Simmons discloses an apparatus for wrapping an article on three sides, which provides a means to grip the an upper margin of the wrapping material and upwardly guide the material into the path of the bundle. Wright et al in U.S. Pat. No. 3,716,960 show an accessory attachment for a bottom wrap inserter that converts it into a three-sided wrap inserter.

Other patents relating to wrapping or bundling devices include U.S. Pat. No. 4,991,376 to Backman, U.S. Pat. No. 5,447,008 to Martin-Cocher, U.S. Pat. No. 4,531,343 to Wood, U.S. Pat. No. 4,726,172 to Widenback, U.S. Pat. No. 4,993,203 to Haloila, U.S. Pat. No. 5,218,813 to Seidel, and U.S. Pat. No. 5,636,496 to Pietila et al.

The above wrapping machines generally employ means for cutting the paper or plastic web between successive wrapping actions. In addition to these means, a variety of such cutting mechanisms have been developed for use on bundle wrapping machines, and for other devices which require the cutting or shearing of a material web. For example, Singer in U.S. Pat. No. 4,328,896 discloses a slitting machine for separating the overlapped portions of a web of continuously laminated articles, where the cutting means consists of two oppositely facing blades mounted to a carriage. U.S. Pat. No. 5,216,873 to Ratzlaffet al reveals a wrapper cutoff mechanism for round balers, which employs a movable knife and stationary anvil. Jennings et al in U.S. Pat. Nos. 5,448,873 and 5,319,899 disclose a net knife for a round baler which has a plurality of side-by-side scalloped shaped sections on one edge of the blade for cleanly severing net material.

Other web cutting mechanisms are disclosed in U.S. Pat. No. 4,852,442 to Pottorff, U.S. Pat. No. 5,259,167 to Underhill et al, U.S. Pat. No. 3,680,610 to Lindgren, and U.S. Pat. No. 5,375,496 to Peru et al.

The above cutting mechanisms generally utilize dangerously sharp, single-sided blades, which require that after making a cut, the blade carriage reverse back upon itself for cutting the next length of paper for the next bundle, thus requiring more time between successive wrapping actions. In addition, the wrapping machine must be equipped so that the paper web is suitably tensioned to allow a clean cutting action. These cutting mechanisms also require greater attention to maintenance and handling of the blade and accessory components.

Thus, a need exists for an improved bundlewrapping machine adapted to function as both a bottomwrapper or a three-way wrapper and which provides a simpler, more effective means for maintaining the paper web in its vertical orientation prior to wrapping, and which utilizes an improved, more efficient cutting mechanism for quickly and cleanly cutting the paper web.

In addition, it would be desirable to integrate a bundleturning device into a bundlewrapping machine: bundleturning devices are commonly used in the print and publishing industry to vary the orientation of the article on a conveyor system prior to or after wrapping. Bundleturners are generally separate pieces of equipment which must be placed next to or in the vicinity of the wrapping machines, thus requiring more space and of course, maintenance of their own components. Thus, a need exists for a wrapping machine that includes a bundleturning assembly as an integral part of its design.

The present invention resolves these and other problems commonly associated with the prior art bundlewrapping machines by providing an apparatus capable of both bottomwrapping and three-way wrapping of a bundle, which includes an improved, more efficient cutting assembly and which incorporates a bundleturning assembly into the wrapping machine.

SUMMARY OF THE INVENTION

It is therefore an object of the present invention to provide a bundlewrapping apparatus adapted to wrap an article on one side or on three sides.

It is a further object of the present invention to provide a bundlewrapping apparatus which includes an integrated bundleturner.

Yet another object of the present invention is to provide a bundlewrapping apparatus with an improved, more efficient cutting assembly for shearing a paper web.

A still further object of the present invention is to provide a bundlewrapping apparatus in which a paper web may be maintained in a vertical orientation prior to cutting and wrapping without requiring creasing, gripping, or other manipulation of the paper web.

Another object of the present invention is to provide a bundlewrapping apparatus which includes means to print informational data mounted above the cutting assembly so that the printing assembly are readily accessible for replacement and maintenance from the top of the apparatus.

An additional object of the present invention is to provide a bundlewrapping apparatus which incorporates an operator control display for easy observance of changing conditions during operation of the system.

A further object of the present invention is to provide a bundlewrapping apparatus which uses an air table integrated into the bottomwrapper to extend the length of the bottomwrapper.

Yet another object of the present invention is to provide an improved method for bottomwrapping and three-way wrapping of an article, such as a bundle of newspapers.

In accordance with the present invention, there is provided an improved bundlewrapping apparatus adapted to wrap an article, such as a bundle of newspapers, moving on a conveyance assembly, on one or more sides with paper dispensed from a roll, preferably kraft paper, depending upon the mode of operation selected. The apparatus broadly comprises means for conveying a bundle along a generally horizontal path, means for vertically dispensing a predetermined length of paper web into the path of the conveyed bundle, means for maintaining the paper web in a vertical orientation until the bundle passes into the paper web boundary, and means for cutting the paper web at the predetermined length. A preferred form of the present invention includes means for rotating the bundle, which is integrated into the wrapper apparatus.

For clarity's sake, the terms "upstream" and "downstream" will be used throughout the description to refer to the directional flow of a bundle through the apparatus. "Upstream" refers to a point in the system that is nearer to the bundle input end of the system. "Downstream" refers to a point in the system that is nearer to the bundle output end.

The apparatus is adapted to operate in several modes: the "conveyor" mode, in which the application of the paper is turned off and the apparatus is used only as a conveyor to move the bundle from one point to the next; the "bottomwrapper" mode, in which the apparatus dispenses paper to the bottom of the bundle as the bundle passes through the system; and the "three-way wrap" mode, in which the apparatus dispenses kraft paper to the top, leading or "downstream" end, and bottom of the bundle as the bundle passes through the system. A turntable, or bundleturning, mode may also be activated for use during any of the three modes.

In operation, as a bundle travels along the conveyor system and passes an upstream sensor, the leading edge of the bundle is detected. If the apparatus is in the conveyor mode, the bundle then continues passing through the system without the application of any kraft paper to the bundle. If the apparatus is in the bottomwrapper mode, paper is applied to the bottom of the bundle as it passes through the system. If the apparatus is in the three-way wrap mode, paper is applied to the bottom of the bundle, and the pre-fed paper between the three-way wrap assembly is pulled around the front, or downstream end and over the top of the bundle. This in turn wraps the bundle on three sides as the bundle passes through the system.

If the apparatus is started in the turntable mode, the bundle is raised, rotated 90 degrees, and lowered back onto the conveyor belt. The paper is then dispensed either under the bundle only if the bottomwrapper mode is selected, or under the bundle and the front or leading edge and top of the bundle, if the three-way wrap mode is selected.

The preferred form of the present invention includes the three-way wrap assembly, which comprises an electrical control tower assembly, a housing or pass-through attachment assembly, a modular assembly mounted to the downstream side of the electrical control tower, and paper support members, preferably, a pair of one-half cylinder belts, one disposed "upstream" and one "downstream" on the conveyor path. When the apparatus is placed into the three-way wrap mode, paper is pre-fed or fed from the paper roll upwardly between the two belts. The belts are positioned so that a three-point contact is made between the belt and the length of paper fed between the belts. By guiding and maintaining the paper in a relatively vertical orientation on the length of the belts, the paper is forced to climb through the vertical belt sections.

After the desired length of paper is pre-fed, a bundle passes through the vertical paper boundary and then is fed under the bottom surface of the bundle, as if in the bottomwrapper mode. As the bundle passes through the belting boundary, the upstream and downstream belts pivot about their respective upper attachment points, sandwiching the paper between the two belts. As the bundle continues passing through the system, the paper is pulled from between the belts and is disposed over the leading end and top side of the bundle. As the bundle passes beyond the reaching length of the belting, the upstream belt returns to the original vertical orientation on the upstream side of the paper feed path. Next, the downstream belt releases and returns to its vertical orientation on the downstream side of the paper feed path. A downstream sensor detects when the passing bundle has passed a desired location so that the paper can be pre-fed between the belts, in preparation for the next bundle.

The two belt system described above allows the paper to be pre-fed at any time prior to the bundle being detected by a sensor. The pre-fed paper will stand vertically for long periods of time without air currents or breezes bending or otherwise disturbing the paper. Other bottom- or three-way wrap devices require that vertically fed paper be folded, creased, corrugated, or otherwise manipulated to allow the paper to maintain its vertical orientation. However, this type of support is only sufficient to hold the paper vertically for a short period of time. Any air currents or other forces will cause the paper to collapse.

Further, the pre-fed length of paper in the present invention can be much longer than traditional three-way wrap designs because the present invention eliminates any mechanical interferences above the paper feed path.

After the paper is dispensed under the bundle in any of the three modes of operation (bottomwrapper, three-way wrap, and turntable-enabled modes) where the paper dispensing is activated, the cutting assembly, including a double-edged, reciprocating knife, is activated, cutting the paper from the roll. A pair of pneumatic cylinders attached to opposite longitudinal ends of the double-edged knife blade drive the blade from a first position at one side of the paper web and through the paper, such that a first longitudinal edge of the blade perpendicularly contacts one vertical side of the web. The blade cuts through the web and continues to the opposite vertical side of the web to a second position. When the material has again been properly fed through to the desired length and is ready to be cut, the cylinders again drive the knife blade back through the second length of material to be cut, such that the second longitudinal edge of the blade perpendicularly engages the material web, thus penetrating it and traveling to the opposite side of the web, where it comes to rest again in the first, starting position. Thus, the blade, by operation of the attached cylinders, is driven in a back-and-forth motion through the paper web feed path, its cycle time limited only by the time necessary to feed or otherwise adjust the length of paper for the next cut.

The cutting assembly preferably includes a pair of elongated support arms, each having one longitudinal edge with a plurality of knife fingers or squared serrations therealong. The support arms are mounted and secured at their opposite ends to the frame of the wrapping apparatus on opposite sides of the feed path, and at an elevation slightly higher than the path of the knife blade. In use, a support arm, or more specifically, its knife fingers support the rear side of the paper web as the knife blade passes through the front side of the web, concentrating the pressure of the knife teeth onto a smaller area of the paper and eliminating the need for additional tensioning of the material to be cut. The combination of the reciprocating motion of the knife blade, its velocity when cutting, and the concentrated cutting force created by the knife fingers allow the knife teeth to be relatively dull to the touch, similar to a butter knife, thus eliminating the need for dangerously sharp blades and their associated maintenance, replacement and sharpening.

A paper dispensing and guide assembly controls the movement and tension of the paper during the above cutting process. The assembly includes first and second roller papers, preferably paper idler roller pairs and drive roller pairs, paper locking means, and paper guide plates.

At the proper time during the cutting cycle, two pneumatic cylinders attached to either side of an idler roller assembly are activated to push the idler rollers into the driven rollers on the opposite side of the paper path. When paper is present and the idler rollers are activated, paper is moved in the direction of the rotation of the drive rollers. A paper locking mechanism is mechanically activated and deactivated by the movement of the paper idler rollers. When the paper idler rollers are in the paper-feed or extended position, two paper lock pins are deactivated or pulled back so that paper can be driven from the paper roll. When the paper feed is in the retracted position, the two paper lock pins are activated, pushing the paper between the paper guides towards the drive side of the paper guide system. During the paper cutting cycle, the paper idler rollers are re-extended into the paper drive rollers. Prior to this re-extension, the paper drive roller shaft rotation is stopped and the idler rollers are forced into the drive rollers, forming a paper lock or brake. At the time the paper idler presses into the stopped drive roller, the double-sided knife is activated. The paper is then held and cut. The paper locking action during the cutting cycle keeps additional paper from being pulled from the paper roll.

A downstream sensor prevents the automatic pre-feed of paper until the upstream or rear edge of the bundle has cleared the sensor. At that time, either a short pre-feed or long pre-feed length of paper is fed between the one-half cylinder belts, depending on the mode of operation selected.

In the preferred form, the present invention includes printing means, preferably an ink jet assembly for printing informational data on the paper with which a bundle or group of bundles may be identified. The printing means, mounted above the path of the cutting assembly, comprises one or two ink jet heads and a printer control and operator interface system, with which the information to be printed is entered. In prior bottomwrapper designs, the ink jet is normally mounted below the elevation of the knife and roller feed assemblies, making it difficult for the operator to gain access to the ink jet heads for maintenance and removal. By mounting the ink jet heads above the cutting assembly, the present invention allows easier access to the printing assembly for maintenance or repair through the top of the machine, and also allows the paper to be printed on the full paper-fed length.

Once a pre-feed is made, the apparatus is ready to accept another bundle. During the pre-feed operation, if the ink jet system is operational identification markings are made on the downstream side of the paper. This identifies the next bundle with distinct identification markings to distinguish it from other bundles or by grouping bundles together with distinct criteria.

A method for wrapping a bundle on three sides is also disclosed, which comprises the steps of placing the article at the input end of a bundlewrapping apparatus; conveying the bundle in a selected direction toward wrapping means; dispensing wrapping material in a direction substantially perpendicular to the path of the bundle; guiding the wrapping material in a direction substantially perpendicular to the path of the bundle so as to allow the bundle to be wrapped by the material on three sides when the bundle contacts the material; maintaining the upper portion of the wrapping material in its perpendicular orientation relative to the path of the bundle by contacting the upper portion at three points with material support means; cutting the wrapping material with a reciprocating double-edged knife; and electronically sequencing the timing of the wrap dispensing, bundle conveyance, cutting, and wrap guiding steps.

The above and other objects, advantages, and features of the present invention will become more readily appreciated and understood from a consideration of the following detailed description of the preferred embodiment of this invention when taken together with the accompanying drawings, in which:

DETAILED DESCRIPTION OF THE PREFERRED EMBODIMENT(S)

Figure 1:
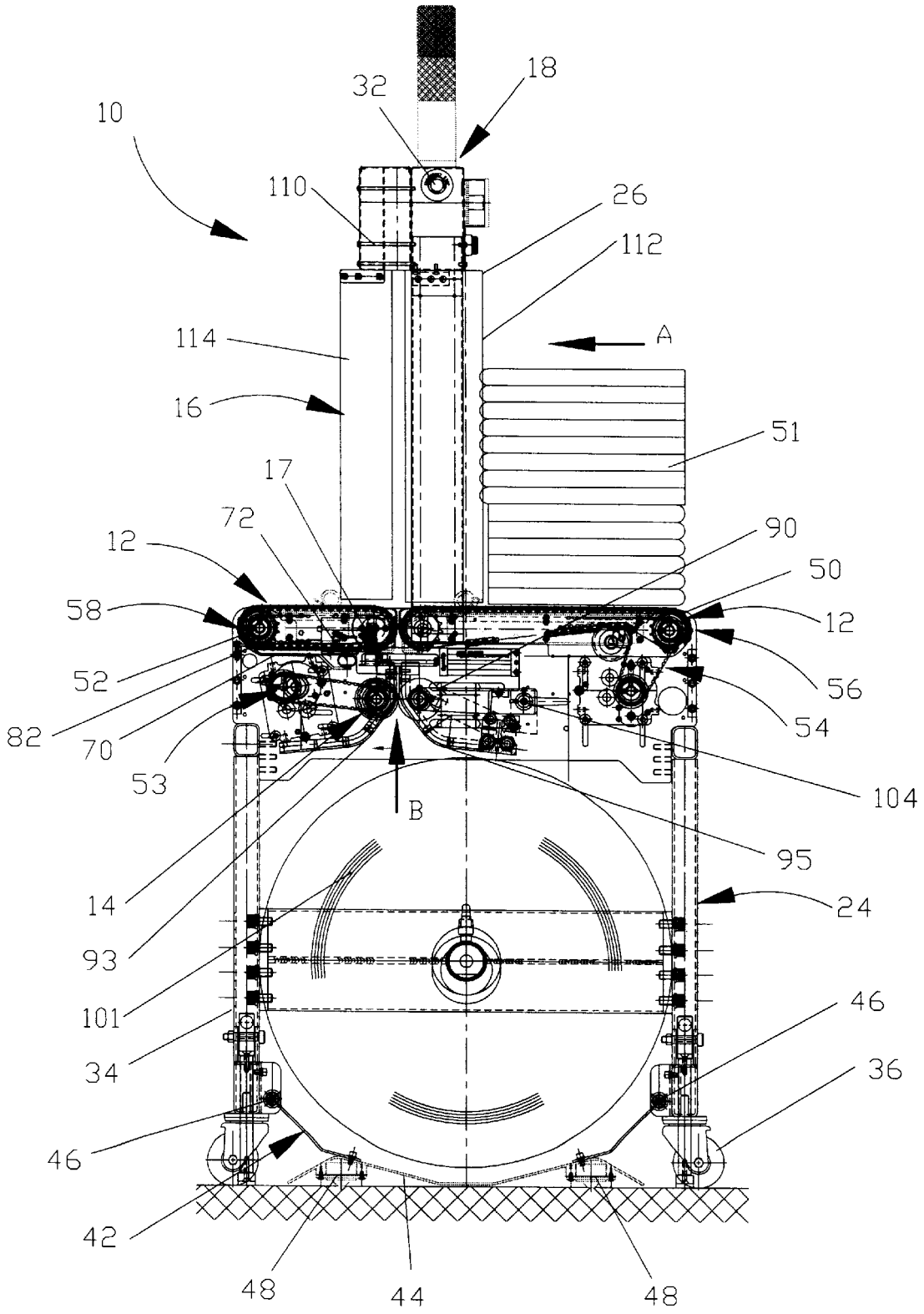
FIG. 1 is a side view of the bundlewrapping apparatus of the present invention.
Figure 1A:
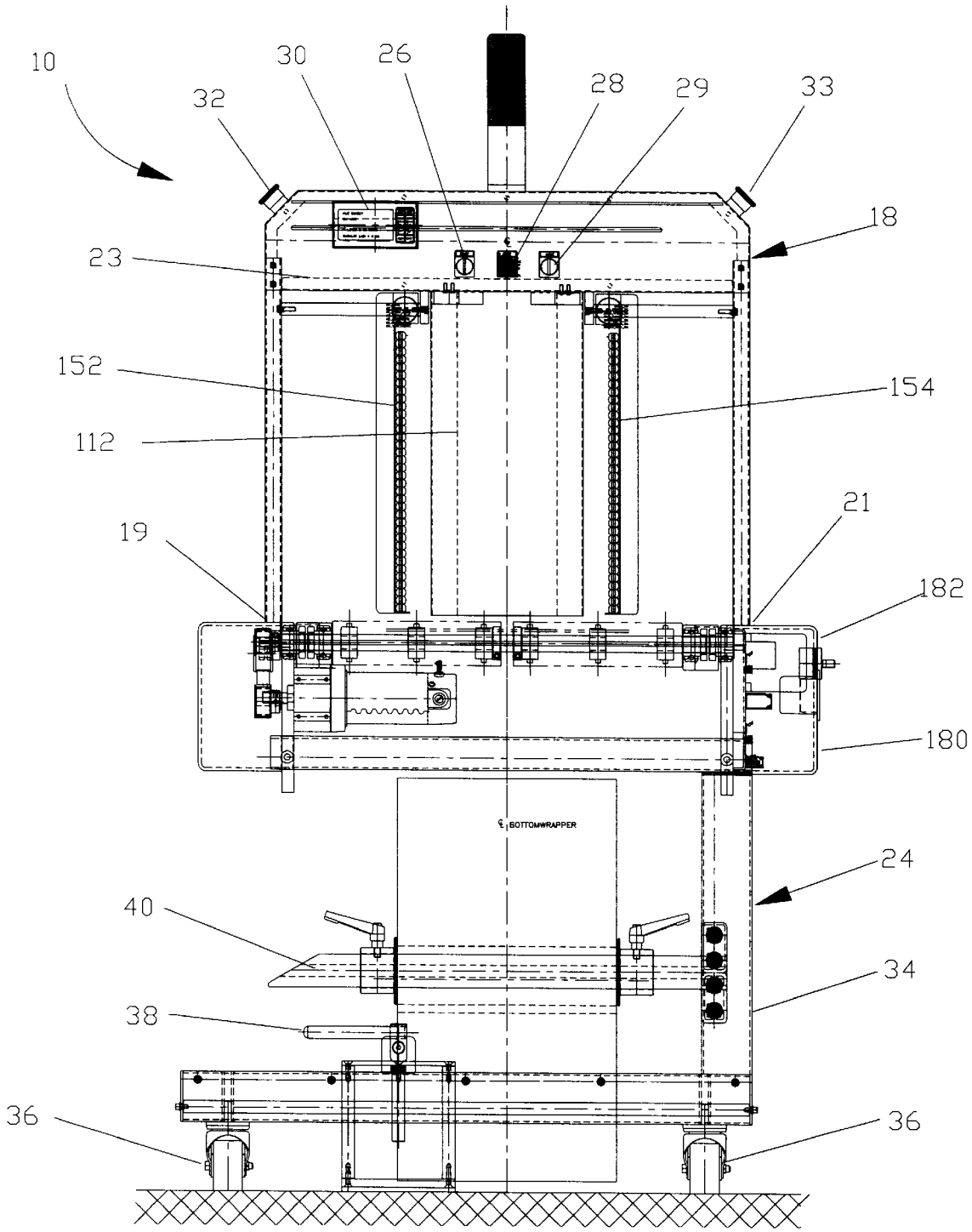
FIG. 1A is an end view of the apparatus.

Referring next to the accompanying drawings, FIGS. 1 and 1A illustrate the bundlewrapping apparatus 10 of the present invention, which broadly comprises a conveyor drive system 12, a paper dispensing and guide assembly 14, a wrapping assembly 16, a cutting assembly, 17, an electrical control tower assembly 18, and a bundleturning, or turntable, assembly 20. The apparatus 10 is contemplated as a wrapper for bundles, particularly generally rectangularly configured stacks of newspapers or similarly sized articles. By selection of the appropriate mode of operation, the apparatus 10 can operate as a bottomwrapper, that is, inserting a single sheet of preferably kraft paper under the bottom surface of the bundle or as a three-way wrapper, that is, covering the bundle with kraft paper on the top and bottom surfaces, as well as the leading or downstream edge or surface. The apparatus 10 can also operate as a simple conveyance device when no wrapping option is selected. In one form of the invention, a bundleturning assembly 20, a turntable-type apparatus, is preferably integrated into the wrapping assembly 16, as will be described in detail with reference to FIGS. 7–8 below.

The apparatus includes a generally U-shaped electrical control tower assembly 18 by which the operation of the entire apparatus is controlled. The tower assembly 18, mounted at its lower ends 19, 21 to the main frame 24 of the apparatus 10, includes a number of operator control buttons 26, 28, 29 for regulating the action of the apparatus. Specifically, these buttons 26, 28, 29 allow the operator to start and stop action of the apparatus 10, as well as select the modes of operation, such as, "start with turntable," "bottomwrapper", "conveyor", and "three-way wrap" modes. The tower assembly 18 also includes an operator control interface 30, on the cross- or transverse arm 23, which allows the operator to change pre-set limits or conditions with respect to the operation of the apparatus 10, or to observe changing conditions regarding the operation of the system. A pair of emergency stop buttons 32, 33 are located on opposite sides of the tower assembly 18. Activating either button 32, 33 stops the apparatus 10, by disconnecting all electrical control voltage and movement of the system.

Figure 5:
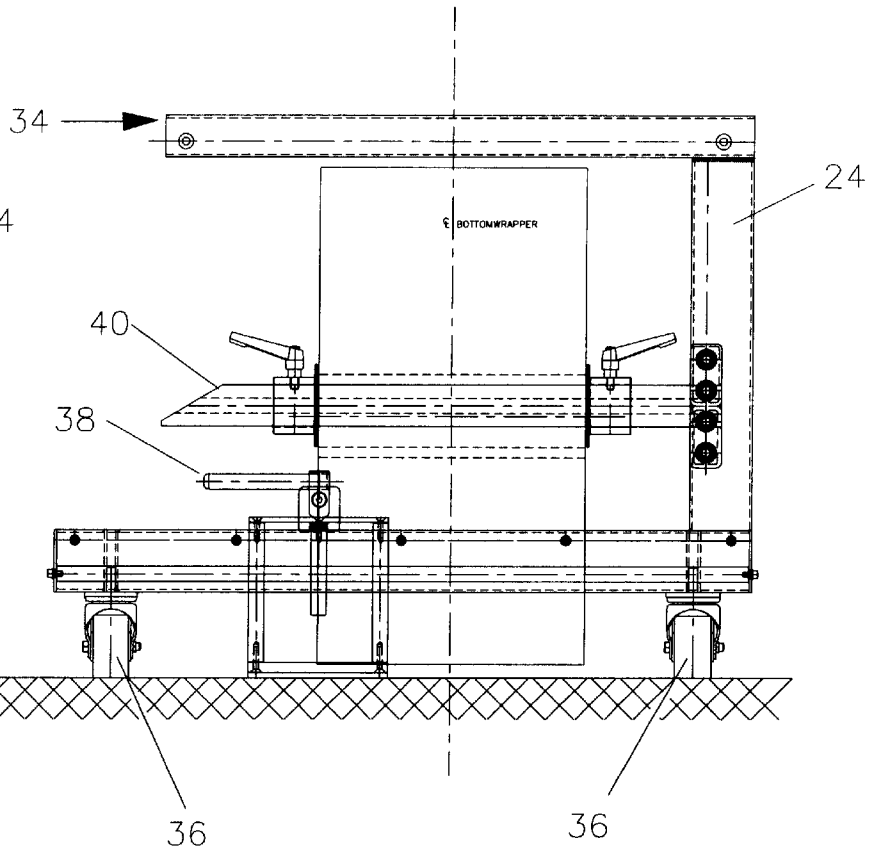
FIG. 5 is a side view of the main frame, illustrating the paper spindle and floor brake.
Figure 4:
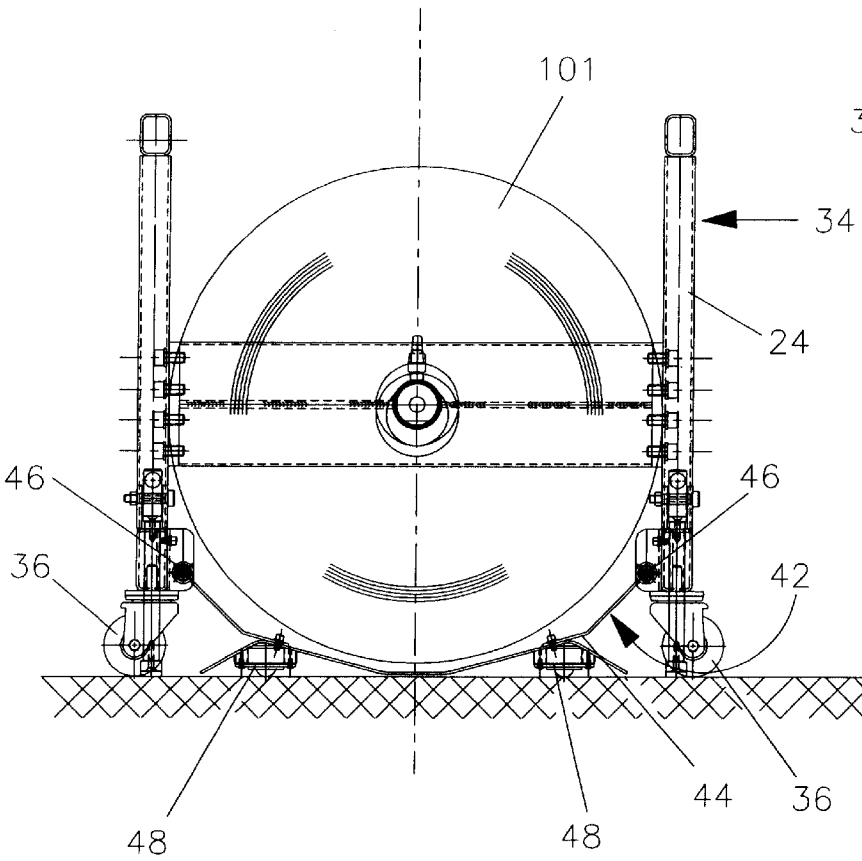
FIG. 4 is a front view of the main frame and roll cart, with the apparatus attached thereto.

As noted above, the tower assembly 18 is secured at its lower ends 19, 21 to the main frame 24 of the apparatus 10. As best shown in FIGS. 4 and 5, the main frame 24 comprises a frame body 34, which supports the apparatus 10. The frame body 34, in turn, is supported by four casters 36, which allow the apparatus to be easily transported. The frame 24 includes at least one integral floor brake 38, which holds the frame 24, and thus the apparatus 10, in place during operation. A paper spindle 40, attached to the frame 24, supports a kraft paper roll and permits the roll to rotate during the feeding operation.

In the preferred embodiment, the frame 24 includes a roll cart 42, which assists the operator in loading the heavy, somewhat ungainly large rolls of paper. The roll cart 42 comprises a gull-wing shaped frame 44 and a pair of attachment brackets 46, which secure the cart 42 to the main frame 24. A plurality of ball transfer rollers 48 mounted to the gull-wing frame 44 allows the cart 42 to be moved in all directions across the floor as the roll cart 42 assists the operator in loading a new paper roll, or as the apparatus 10 is moved to a new location. As the cart 42 is secured to the main frame 24, the cart 42 is retained with the apparatus 10 during all operations.

The conveyor drive system 12, which moves a bundle 51 placed thereon through the wrapping system, will now be described with reference to FIGS. 2, 2A, 2B, and 3. The flow direction of the bundle's 51 movement through the system is designated with the arrow A. As illustrated, the conveyor system 12 comprises a first conveyor section, or a long swing arm conveyor, 50 and a second conveyor section, or a short swing arm conveyor, 52. Conveyor drive motor 54 operates to move both conveyor sections, 50, 52. Paper drive motor 53 operates to drive the kraft paper roll to feed the paper into the wrapping assembly 16, as will be described below.

The long swing arm conveyor 50 conveys the bundle 51 from a first, input end 56 of the apparatus 10 to the wrapping assembly 16. As will be described below, the long swing arm conveyor 50 can be modified to a second configuration to allow use of the bundleturner 20. Short swing arm conveyor 52 conveys the bundle 51 from the wrapping assembly 16 to a second, opposite output end 58 of the apparatus 10 after the wrapping operation is completed. Conveyor section 52 can also be modified to a second configuration to allow the use of printing means, an ink jet assembly, 70, which will be described in detail below. The paper path, designated by arrow B, passes between the two conveyor sections 50, 52.

Figure 3:
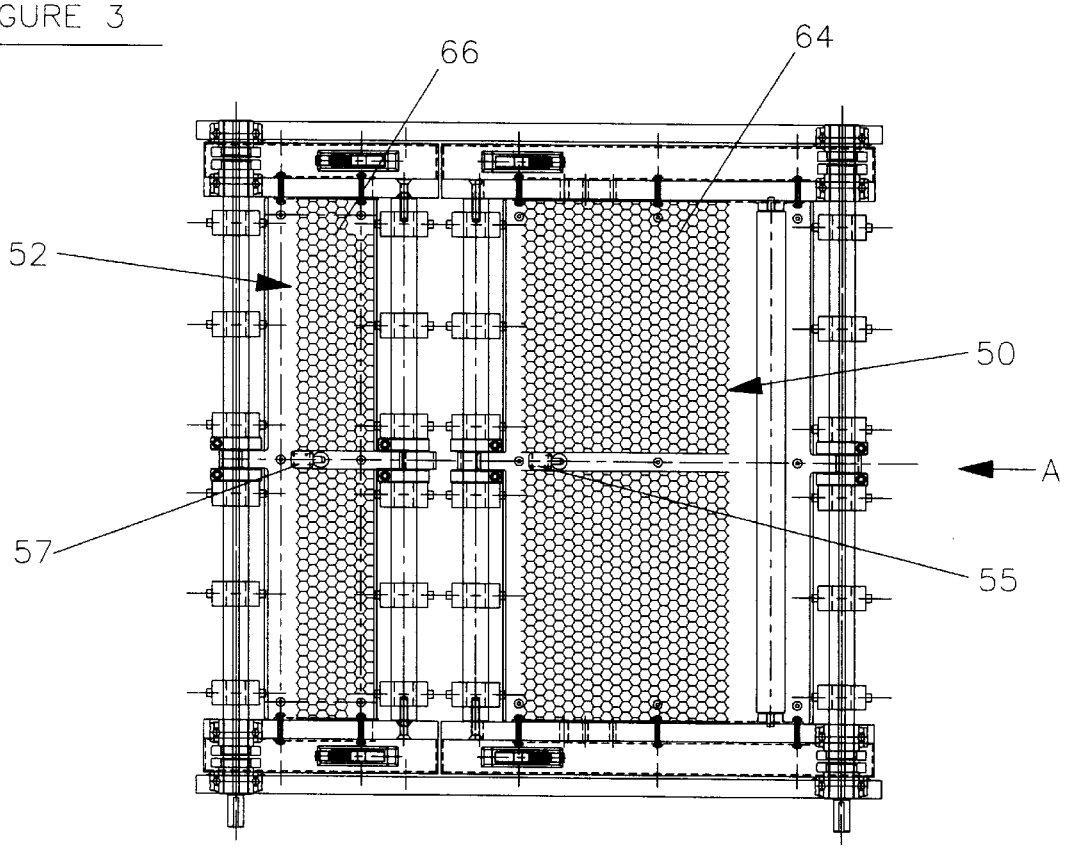
FIG. 3 is a top view of the conveyor drive system, illustrating the location of the upstream and downstream bundle sensors.

As best shown in FIG. 3, the conveyor system 12 includes first and second sensors, preferably a pair of standard "electric eye" sensors: an upstream bundle sensor 55 is disposed proximate one end of the long swing arm conveyor 50 to detect the bundle 51 as it approaches the wrapping assembly 16. Sensor 55 relays to the wrapping system that a bundle is approaching to be handled in the selected mode of operation, as will be described in more detail below. Downstream bundle sensor 57 is disposed proximate one end of the short swing arm conveyor 52 to detect the rear edge of the bundle after the wrapping operation is completed. Sensor 57 prevents the paper roll 80 from pre-feeding for the next wrapping cycle until the previous bundle has reached the downstream sensor 57 and cleared the wrapping system 16.

Figure 2:
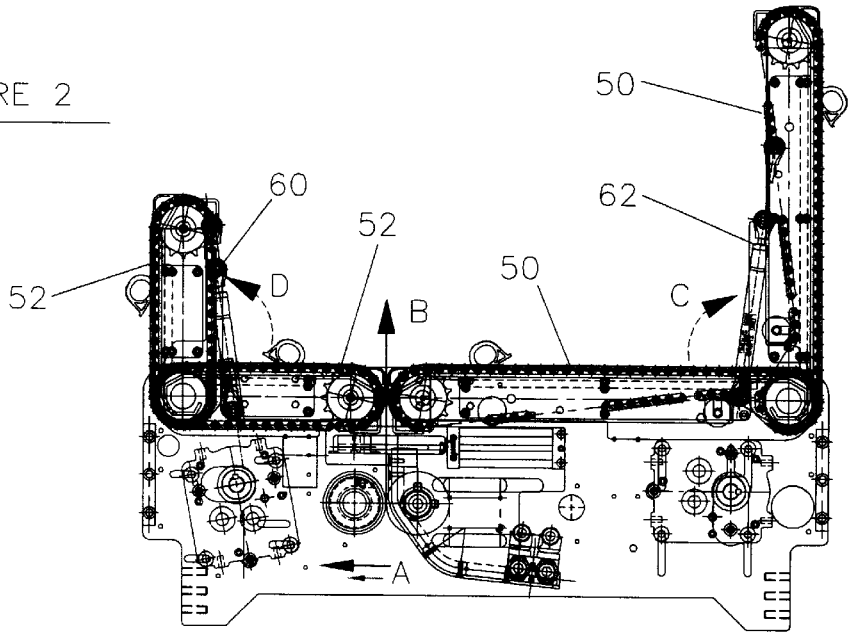
FIG. 2 a side, cross-sectional view of the apparatus with the three-way wrap assembly and electrical control tower detached, illustrating the conveyor drive assembly and showing the swing arm assemblies in the opened position.
Figure 2B:
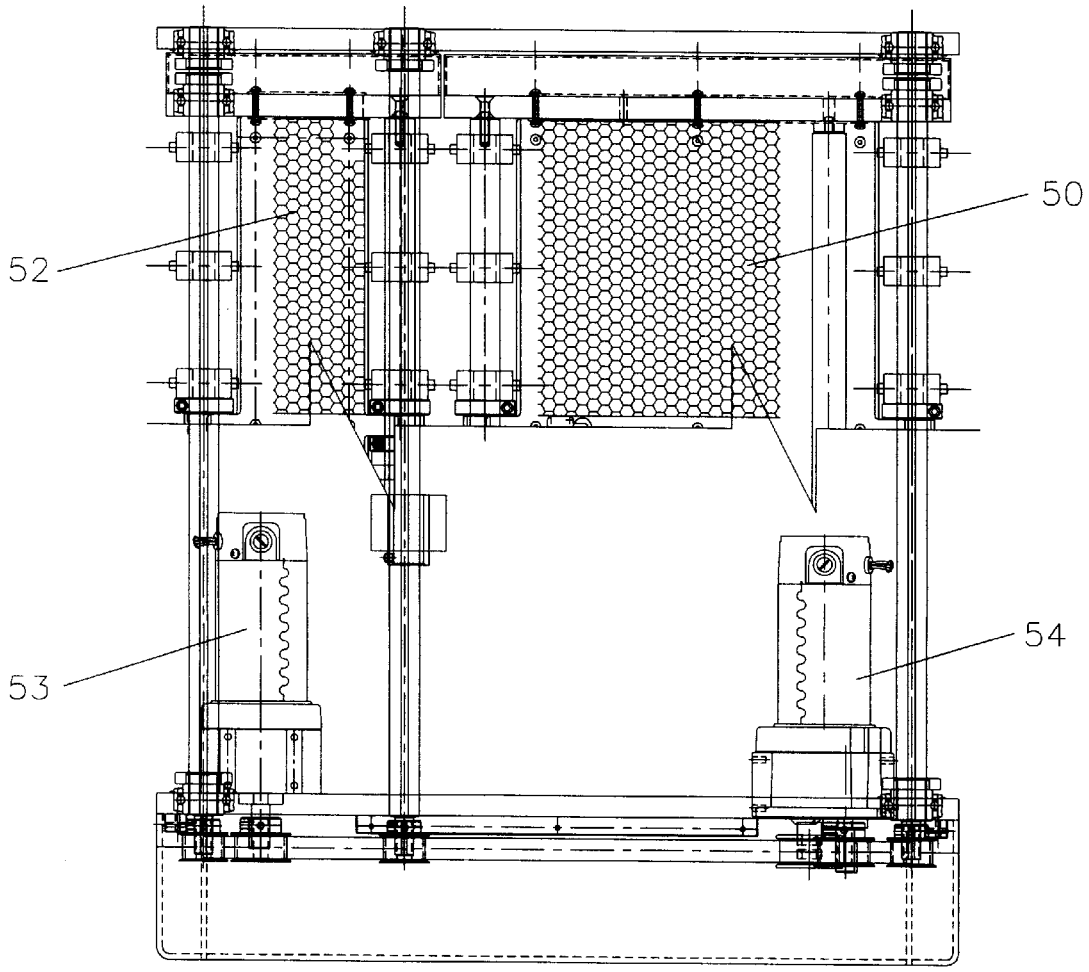
FIG. 2B is a top view detail of the paper drive and conveyor drive systems.
Figure 2A:
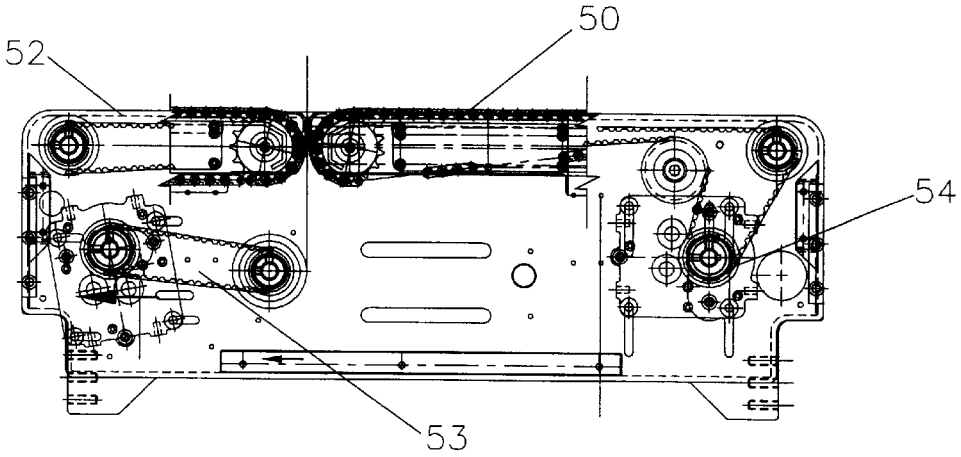
FIG. 2A is a side view detail of the paper drive and conveyor drive systems.
Figure 3A:
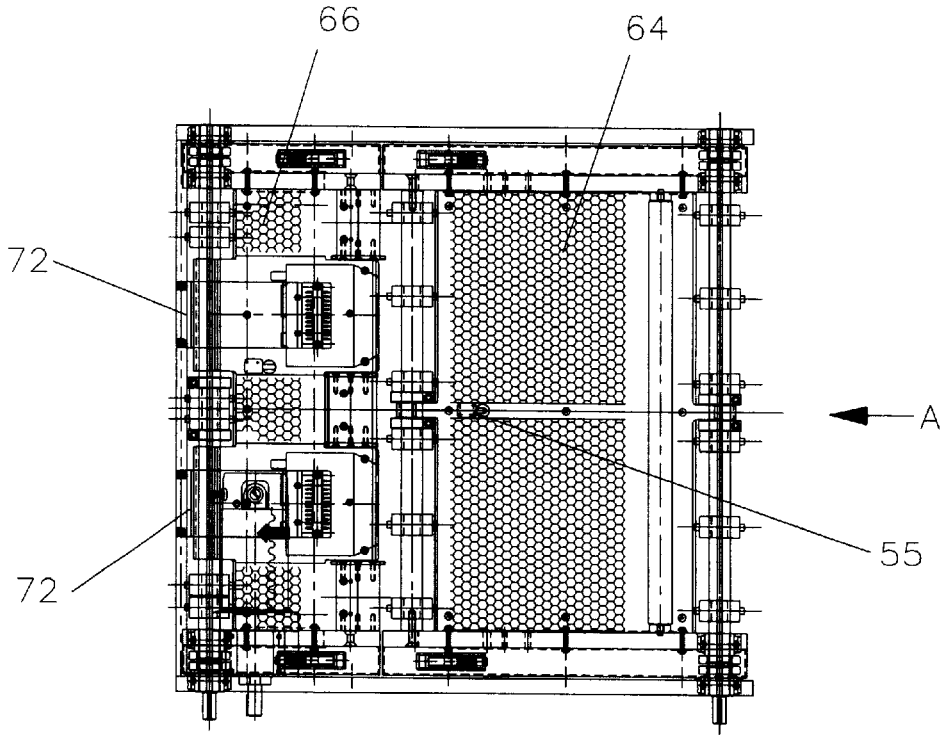
FIG. 3A is a top view of the conveyor system, illustrating the embodiment of the present invention which includes the printing means with two ink jet heads.
Figure 3B:
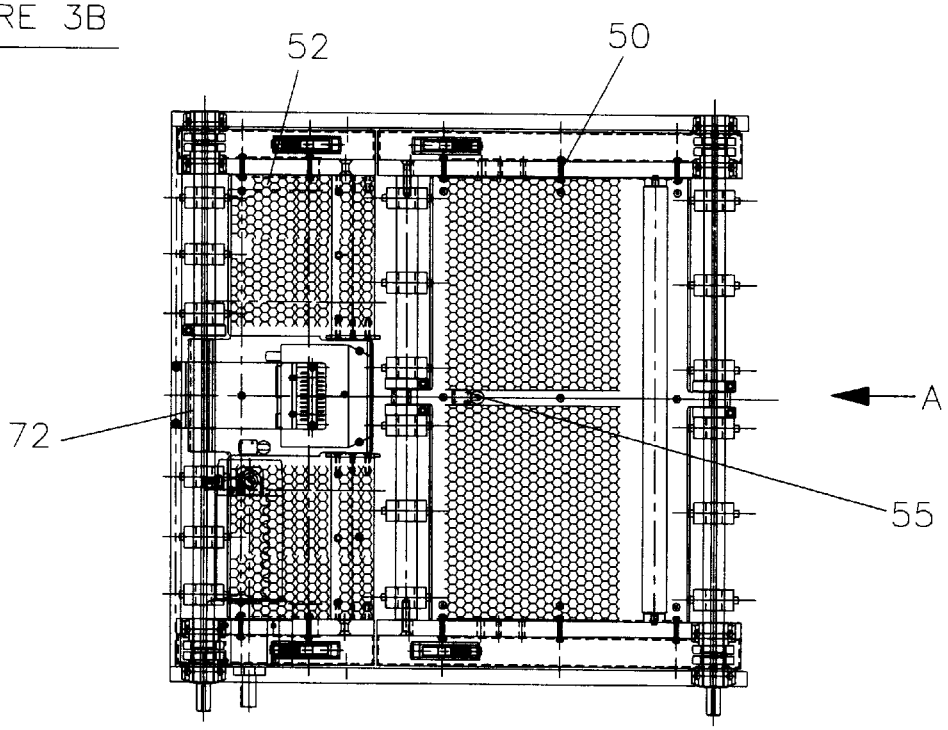
FIG. 3B is a top view of the conveyor system, illustrating the embodiment of printing means with only one ink jet head.

FIGS. 1 and 2A depict the conveyor sections 50, 52 in a closed, relatively horizontal position on which the bundles are conveyed through the system. As the name imply, and as shown in FIG. 2, each of the swing arm conveyor sections 50, 52 is adapted to be swung open to allow easy access to the underlying components of the apparatus for maintenance and repair. That is, each conveyor section 50, 52 rotates about one end and is swung into a substantially vertical orientation, as designated by arrows C and D, relative to the operational position shown in FIG. 1. Gas springs 60, 62 maintain the conveyor sections 50, 52 in the vertical orientation shown in FIG. 2.

The conveyor sections 50, 52 include conveyor belting 64, 66, respectively, are preferably comprised of a lightweight plastic mesh or sheets, as best shown in FIG. 3, which offer better traction and conveyor action for the bundles moving through the system. Standard conveyor belts, usually made of rubber or durable plastic material, could also be utilized in the conveyor system of the present invention.

As mentioned above, the short swing arm conveyor 52 is adapted to be modified to allow the use of a printing system 70, an ink jet assembly which ejects ink from a head assembly in a dotted pattern towards an object, such as the pre-fed kraft paper, passing within a pre-determined distance in the path of the ink jet heads. The slider bed 80 of conveyor 52 is modified to allow the installation of at least one ink jet head 72, mounted beneath the upper conveyor surface 61 of the short swing arm conveyor 52, using a mounting bracket 82. The conveyor belting 66 is thus configured so that the ink jet head 72 is disposed between the circular path of the belting 66.

By modifying the short swing arm 52 in this manner, one or more ink jet heads 72 can be mounted above the cutting assembly 17, such that the paper can be printed along the fill, pre-fed paper length. A further advantage of the printing system 70 over prior art designs lies in that fact that the ink jets are not attached to the short swing arm conveyor 52, thus permitting the arm 52 to be swung open for normal ink jet head maintenance and care. Also, in prior art wrapping devices which employ means for printing information on the wrapping material, ink jet heads are normally mounted below the elevation of the cutting assembly and roller feed assembly, making it more difficult for the operator to gain access to the heads for maintenance and removal.

Figure 7:
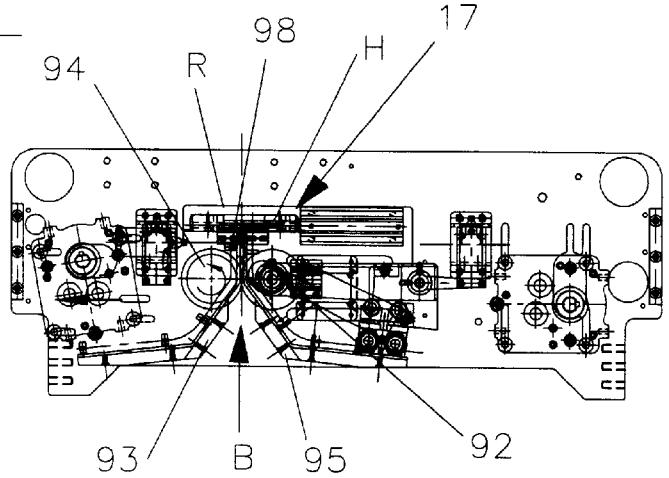
FIG. 7 is a cross-sectional side view of the apparatus, illustrating the paper dispensing and guide assembly and cutting assembly.
Figure 8A:
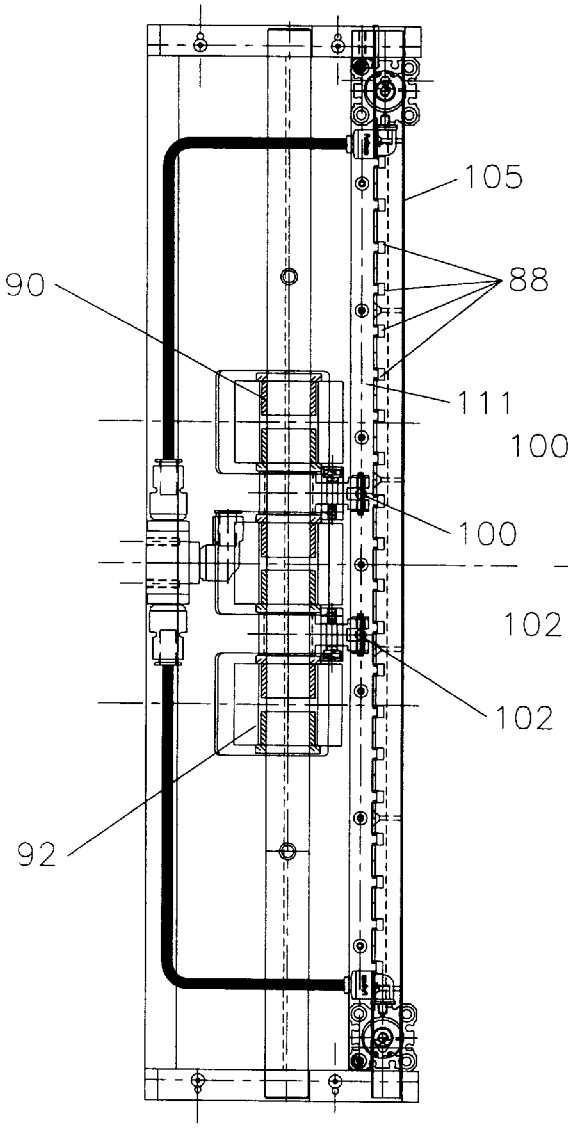
FIG. 8A is a side view of the paper guide assembly.
Figure 8:
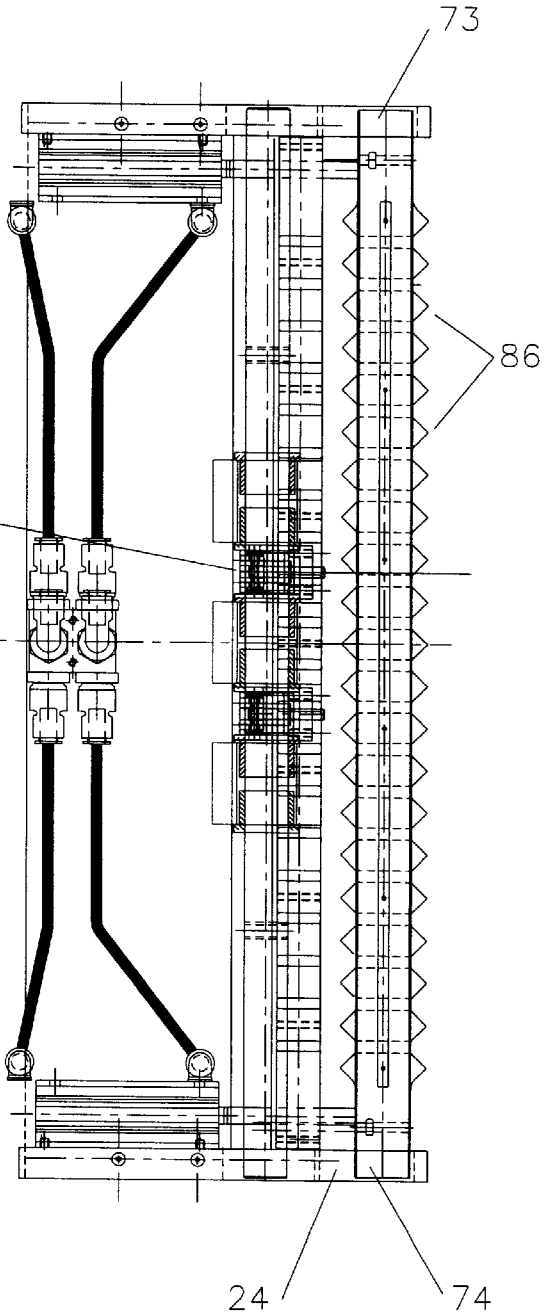
FIG. 8 is a cross-sectional side view of the apparatus, showing the paper dispensing and guide assembly and cutting assembly.
Figure 9A:
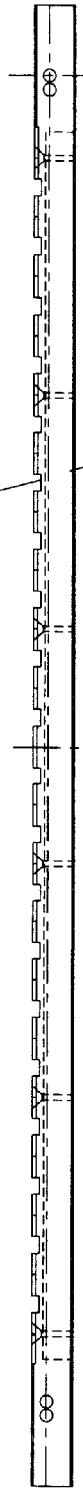
FIG. 9A is a detail of the knife support arm.
Figure 9:
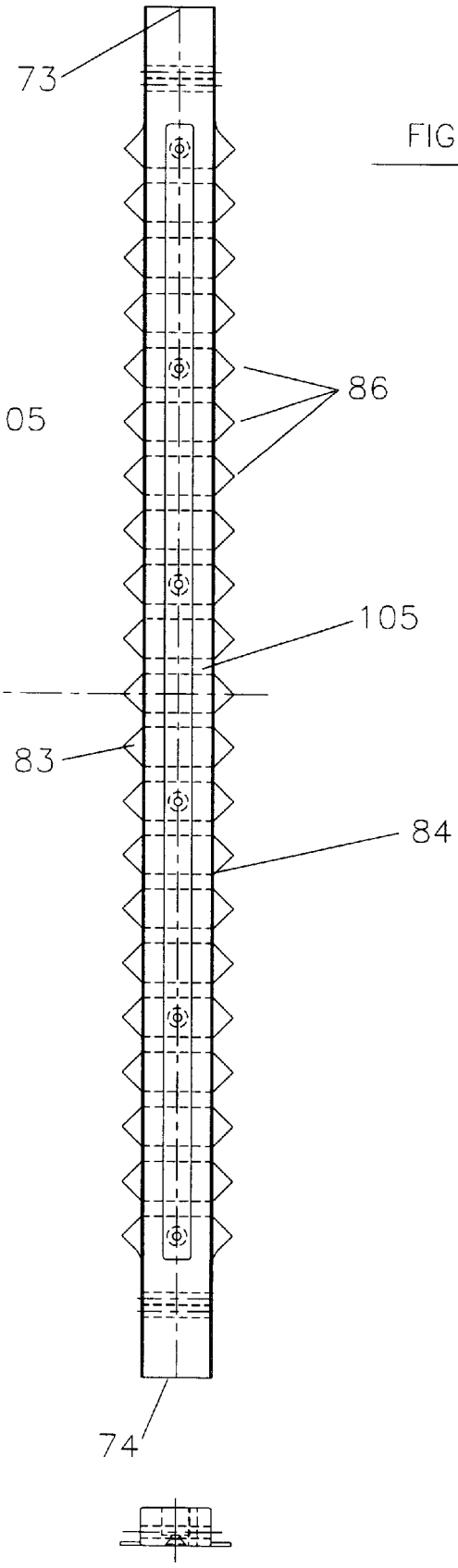
FIG. 9 is a detail of the double-edged knife and support arm.

The paper dispensing and guide assembly 14 will now be described with reference to FIGS. 6–8. The assembly 14 includes paper idler rollers 90, 92, paper drive rollers 94, 96, paper locking means 98, paper guide plates 93, 95, and the cutting assembly 17. When a bundle is detected by the upstream sensor 55, a pair of pneumatic cylinders 97, 99 attached to either side of a pair of idler rollers 90, 92 are activated, pushing the idler rollers 90, 92 into the drive rollers 94, 96 on opposite sides of the paper path B. When paper 91 is present and the idler rollers 90, 92 are activated, the paper 91 is moved in the rotational direction of the drive rollers 94, 96.

The paper locking means 98 is mechanically activated and de-activated by the movement of the paper idler rollers 90, 92. When the idler rollers 90, 92 are in the paper feed, or extended position, a pair of paper lock pins 100, 102 are de-activated and pulled back so that paper can be driven from the kraft paper roll 101. When the idler rollers 90, 92 are in the retracted position, the paper lock pins 100, 102 are activated, pushing the paper between a first, stationary paper guide plate 93 and a second, moveable paper guide plate 95 toward the drive side of the paper guide system. This action, in turn, locks the paper 91, preventing it from being pulled from the paper roll 101 during the cutting procedure.

The paper guide assembly 14 further includes an over center cam mechanism 104, which, when rotated, allows the moveable paper guide plate to be moved back toward the input end 56 of the apparatus 10, where the bundle 51 is initially fed through the system. Movement of the cam mechanism 104 broadens the distance between the two paper guide plates 93, 95, thus permitting easier loading of the kraft paper. Once the paper sheet 91 is placed between the paper guide plates 93, 95, the over center cam mechanism 104 is rotated in the opposite direction, locking the paper 91 between the two paper guide plates 93, 95, thereby placing the paper 91 in the appropriate position to be fed during operation of the machine. When the assembly 14 is locked into place, a guide or paper path B is created which directs the paper from the paper roll 101 to the wrapping assembly 16, where the paper 91 is either placed only under the bottom surface of the bundle or three-way wrapped about the bundle in the manner to be described below.

The wrapping assembly 16 will now be described with reference to FIGS. 10, 11 and 11A. As discussed previously, the apparatus 10 is contemplated for use as both a bottom-wrapper or a three-way wrapper, depending upon the mode selected by the operator on the operator control interface 30. If the apparatus 10 is in the bottomwrapper mode, the paper 91 is dispensed from the roll 101 through the guide system 14 and upwardly between the two conveyors 50, 52, as described above, and the paper 91 is applied to the bottom surface only of the bundle 51 as it passes through the conveyor drive system 12 toward the output end 58 of the apparatus.

The apparatus is also adapted to wrap a bundle on three-sides, specifically, the bottom and top surfaces, and the leading or downstream end of the bundle when a three-way wrap assembly 16 is attached to the apparatus and by selection of the three-way wrap mode. The three-way wrapping assembly 16 comprises a housing, or pass-through attachment 110 and first and second paper support members 112, 114, preferably a pair of belts, each configured in half cylinder. The housing or pass-through attachment 110 is a modular assembly secured to the transverse arm 23 of the control tower 18, on the side opposite the operator control interface 30, or the "downstream" side of the tower 18 as the bundle travels through the system. The housing 110 includes an elongated, generally oval tunnel or chamber 116 through which the upwardly directed pre-fed paper passes, thus allowing for a longer pre-fed paper length than normally seen in wrapper devices.

A first paper support member 112 is pivotally attached at its upper end 120 to the underside of the transverse arm 23 of the tower assembly 18, on the "upstream" side of the tower 18, to extend downwardly toward the upper surfaces of the conveyors 50, 52. Pivotally attached at its upper end 121 beneath the housing 110, also extending downwardly toward the upper surfaces of the conveyors 50, 52, is the second paper support member 114, or downstream belt 114. Each of the support members 112, 114 is configured to form a half of a cylinder, that is, bent or otherwise manipulated to form and maintain a generally C-shaped cross-section, as best shown in FIG. 10. Forming the belts 112, 114 into the half-cylinder configuration allows the belts 112, 114 to collapse easily when the bundle passes into and contacts the outside perimeter P of the belts 112, 114. When the belts 112, 114 are pushed into a collapsed position by the bundle 51 passing through the system, that is, the lower ends 118, 119 of the belts 112, 114 are pushed downstream of the upper ends 120, 121 of the belts, and then released as the bundle passes through the belts 112, 114, the belts 112, 114 will spring back to their original vertically hanging position on the upstream and downstream sides of the paper feed path B, respectively. As the belts 112, 114 return to this vertical orientation, they become relatively rigid, thereby preventing the belts 112, 114 from swinging back and forth across the paper path B, reducing the pendulum action of a flattened belt system. The half-cylinder configuration also isolates the bundle 51 from the paper 91 when using the bundleturning mechanism 20 described below.

Figure 10:
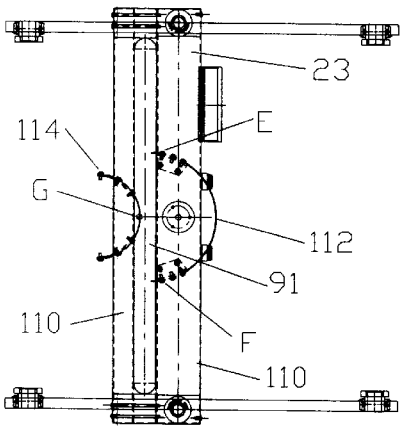
FIG. 10 is a detail top view of the three-way wrap assembly, illustrating the upstream and downstream belts and three-point contact.
Figure 10:
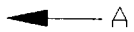
Figure 11A:
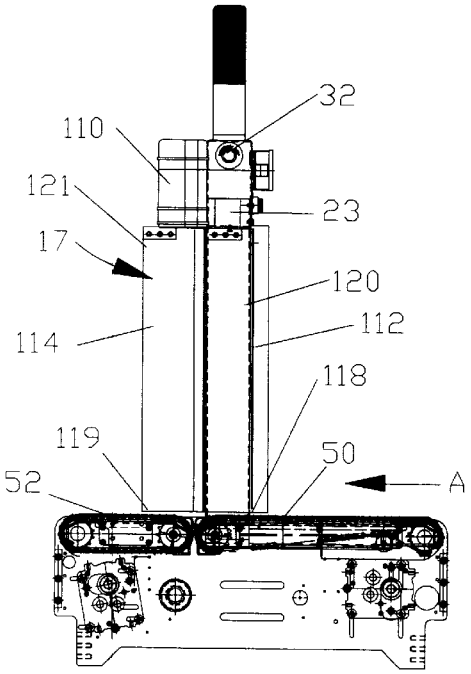
FIG. 11A is a side view of the three-way wrap pass through attachment.
Figure 11:
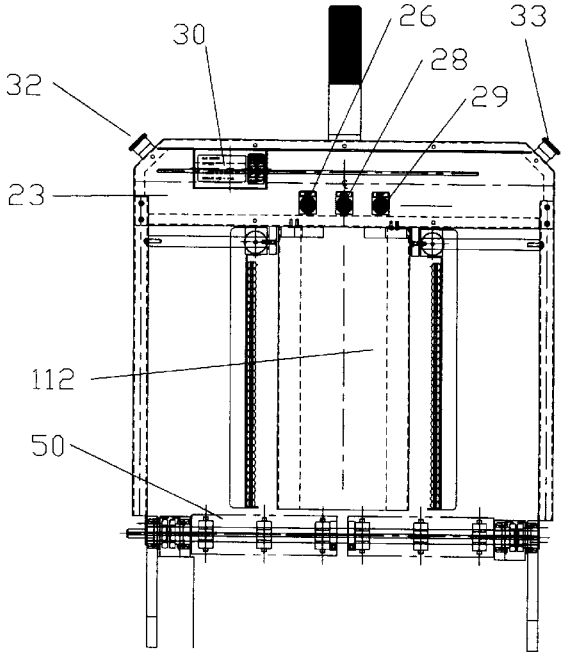
FIG. 11 is a front-end view of the three-way wrap assembly, illustrating the upstream belt.

The paper support members 112, 114 are arranged to contact the paper fed therebetween on three points, as shown in FIG. 10 as points E, F and G, thereby lightly supporting the upper margin of the paper 91 and maintaining the paper in a vertical orientation during the wrapping operation.

In operation, when the apparatus 10 is placed in the three-way wrap mode, paper is fed through the paper dispensing and guide assembly 14, as above described, up between the paper support belts 112, 114 so that a three-point contact E, F, G, is made between the belts 112, 114 and the upper margin of the paper 91. The paper, by being maintained in a substantially vertical orientation during the paper dispensing and guiding actions, is forced to climb through the vertical belts 112, 114.

After the desired pre-fed length of paper is fed upwardly between the belts 112, 114, a bundle then passes through the kraft paper boundary and the paper under the bundle is fed as in the normal bottomwraper mode of operation. As the bundle passes through the upstream and downstream belts 112, 114, the belts pivot about their respective upper attachment points, sandwiching the paper 91 between the two belts 112, 114. As the bundle continues passing along the conveyors 50, 52, the sandwiching effect of the belts 112, 114 produces a consistent friction between the belts 112, 114 and the paper 91. The paper 91 is pulled from between the belts 112, 114 and is placed over the leading or downstream and top sides of the bundle. As the bundle passes through each paper support belt 112, 114, each belt swings back into its original, vertically hanging position. Downstream sensor 57 detects when the bundle has passed, thereby indicating to the paper dispensing and guide assembly 14 when the next length of paper is to be pre-fed in preparation for the next bundle. However, the two-belt design allows the paper to be pre-fed at any time prior to the bundle being detected by the sensor 57, as the paper will stand vertically for long periods of time without air currents or other disturbances causing it to collapse, thus eliminating the need to fold, crease or corrugate the paper for it to maintain a vertical orientation.

After the wrapping operation is completed, the paper 91 is cut from the roll 101 by the cutting assembly 17. As noted above, the paper dispensing and guide assembly 14 includes the cutting assembly 17, best illustrated in FIGS. 6 through 9. The cutting assembly 17 is preferably mounted on opposite sides of the paper path B. The assembly 17 includes a double-edge or double-sided knife 102, pneumatic cylinders 106, 107, pneumatic manifold 108, and support arms or knife wear strips 111.

In operation, the double-edged knife 105 is driven by activation of the cylinders 106, 107 from a first, home position H to a second, resting position R, crossing the paper path, thus perpendiculary contacting and cutting the pre-fed, vertically oriented sheet of paper 91. The paper roll 101 is then advanced so that the desired length is again driven upwardly through the path B and into the path of the knife 105, at which point the knife 105 is again driven by cylinders 106, 107 from the second position R back to the first position H, again perpendicularly contacting and cutting through the paper 91.

Figure 6:
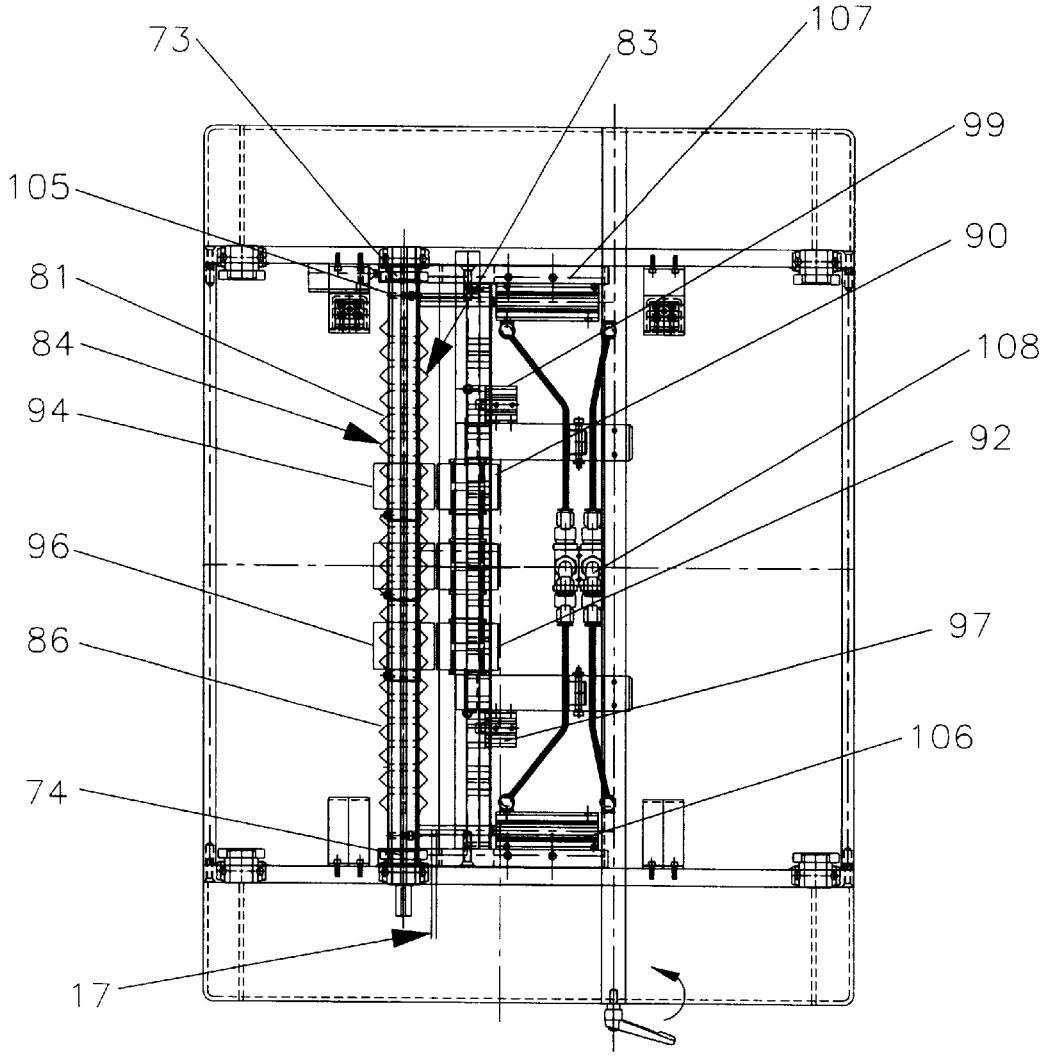
FIG. 6 is a detailed top view of the apparatus, illustrating the paper dispensing and guide assembly and cutting assembly.

FIG. 6, a top view of the apparatus 10, illustrates in more detail the cutting assembly 17, specifically, the double-sided knife 105. The knife 105 comprises an elongated blade 81 having opposing longitudinal edges 83, 84. Each edge 83, 84 is adapted to cut the paper 91 and includes a plurality of teeth or serrations 86, preferably triangularly configured. Preferably, the length of the blade 81 is at least as long as the width of the sheet of paper, but may be longer than the width of the paper 91 and still achieve the desired cutting effect. Blade lengths between 11 and ½ to 20 inches have proven to be effective.

The blade 81 may include a plurality of openings or slots 87 disposed above and beneath the knife teeth 86, which are adapted to receive cooperating knife fingers or extensions 88 on the support arms 111, when the support arms 111 are utilized. The support arms will be described below.

The knife 105 is connected at its longitudinal ends 73, 74 to a pair of pneumatic cylinders 106, 107, which, as described above, operate to drive the knife 105 from the first position H to the second position R, and then back from the second position R to the first position H. Thus, cutting edge 83 perpendicularly contacts and the paper 91 as the knife 105 travels from the first position H to the second position R. Cutting edge 84 perpendicularly contacts and cuts the paper 91 as the knife travels from the second position R back to the first position H. The above process is continuous, with the knife 105 traveling back and forth cutting segments of the paper as it is advanced into the path of the knife 18. Thus, the continuous, back and forth effect of the knife's 105 action eliminates the step, seen in most prior art cutting devices, of reversing the knife back into a first position, where it idles until the paper is advanced into position for cutting, saving time and increasing the number of cycles completed in any given amount of time.

In the preferred form, the cutting assembly 17 includes a pair of elongated support arms 111, 113 or knife wear strips. Each support arm 111, 113 is mounted at its longitudinal ends 75, 76 to the main frame 24, preferably at a height slightly above the horizontal cutting path of the knife 105, and on opposite sides of the upwardly fed paper 91. Each support arm 111, 113 includes a plurality of support fingers 88, or squared serrations, extending upwardly from the top surface of the arm 111, 113.

In use, a support arm 111 and fingers 88 lightly contact and support the back surface the paper 91 as the blade 81 cuts the opposite facing, or front, surface of the paper 91, as the blade travels from H to R. Likewise, when the cutting action is reversed, support arm 113 will support backside of the paper 91 while the blade 81 cuts the opposite face of the paper 91, traveling from R to H.

The knife fingers 88 concentrate the cutting force on a smaller area of the paper 91, and thus eliminate the need for downstream tensioning of the paper web.

As noted above, because of the location of the support arms or knife wear strips 111, 113 relative to the knife blade 81, the knife blade 81 necessarily includes a plurality of openings or slots 87 therethrough on either side of the knife teeth 86, through which the knife fingers 88 pass during the cutting motion, thus preventing the knife blade 81 from being blocked or stopped by the support arms 111, 114 during cutting.

It is contemplated that the preferred form of this invention employ triangularly shaped knife teeth 86, which are relatively dull to the touch, compared with the sharp cutting means often employed to cut paper or plastic web. The combination of the concentrated cutting force of the knife fingers 88, the velocity of the knife 105 in motion, and the back-and-forth movement of the knife 105 relative to the upwardly extending paper web eliminate the need for the often dangerously sharp blades used to cut such wrapping materials.

Preferably, the knife blade 81 is composed of a lightweight, yet strong and durable material, such as Delrin, an acetyl, or other similar materials, to eliminate the use of standard steel or metal knife blades and obtain the needed velocity to obtain a clean cut. Likewise, the support arms 111, 113 are also constructed of Delrin to increase their durability as well.

While the cutting assembly 17 is illustrated herein as working in conjunction with the bundlewrapping apparatus, and is included as part of the paper dispensing and guide assembly 14, it is contemplated that the cutting assembly 17 can be used in other applications and in other apparatus in which a continuous, quick, and efficient shearing or cutting action is desired. For instance, the cutting assembly 17 can be adapted for use in hay baler apparatus, which require that netting be cleanly cut from a web prior to wrapping the bales. The reciprocating action of the cutting mechanism 17 is also contemplated for use in continuously cutting any number of materials other than paper, plastic or net webbing, such as cheese, soft meats, or other substances.

A second embodiment of the bundlewrapping apparatus of the present invention 10 includes an integrated bundleturner, or turntable, assembly 20. While bundleturning apparatus are commonly used in the publishing and print industries to turn bundles of newspapers and other publications, the bundleturner is generally a separate device, and when used with a wrapping apparatus, is typically placed near one end of the conveyor system, thus requiring additional floor space and separate maintenance.

As illustrated in FIGS. 12, 13, 13A and 13B, the present invention contemplates a bundleturner assembly 20 as an integral component of the bundlewrapping apparatus 10 by modification of the long swing arm conveyor 52. The bundleturner assembly 20 includes bundle lift cylinder 130, bundle turn cylinder 132, bundle stop cylinders 134, 136, and bundle plate 140.

Figure 13:
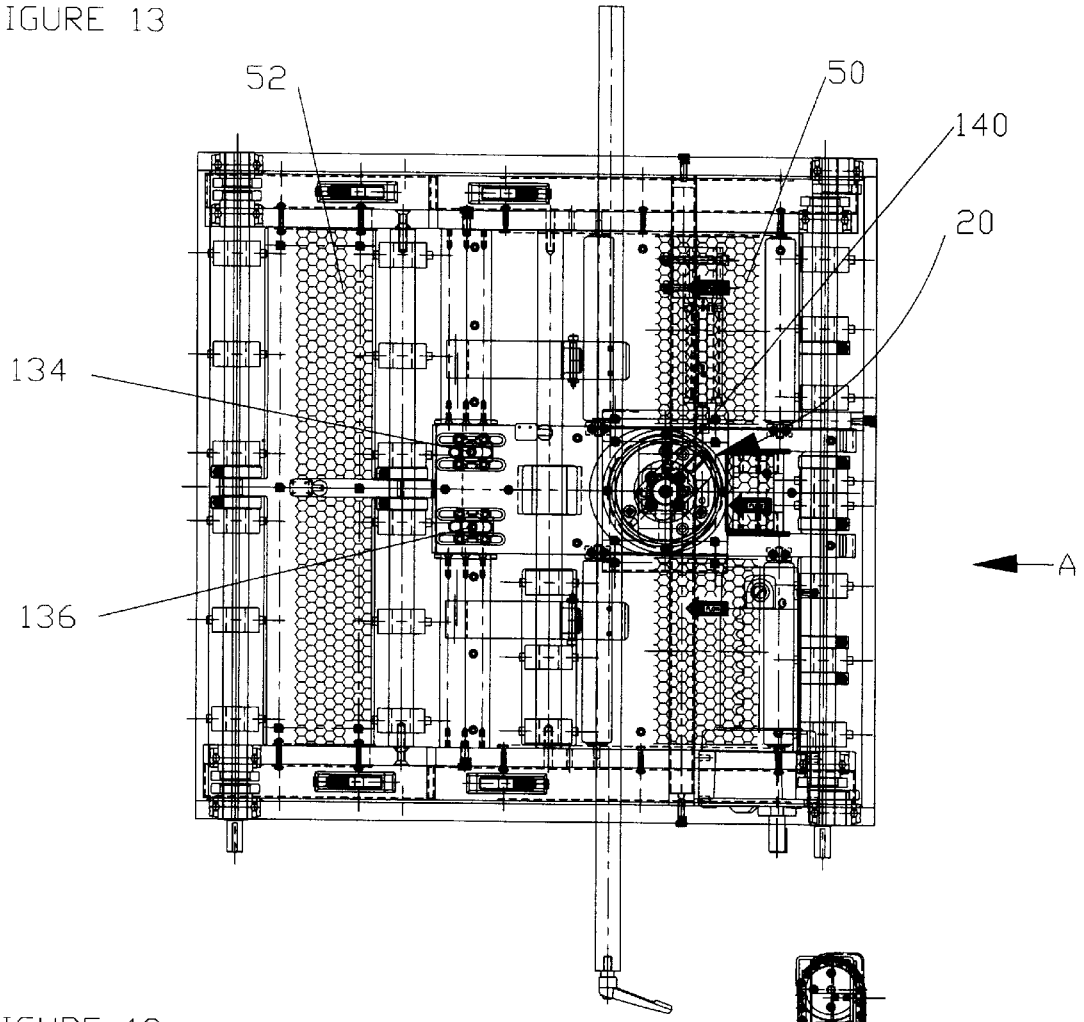
FIG. 13 is a top view of the bundle turner installed in the apparatus.
Figure 12:
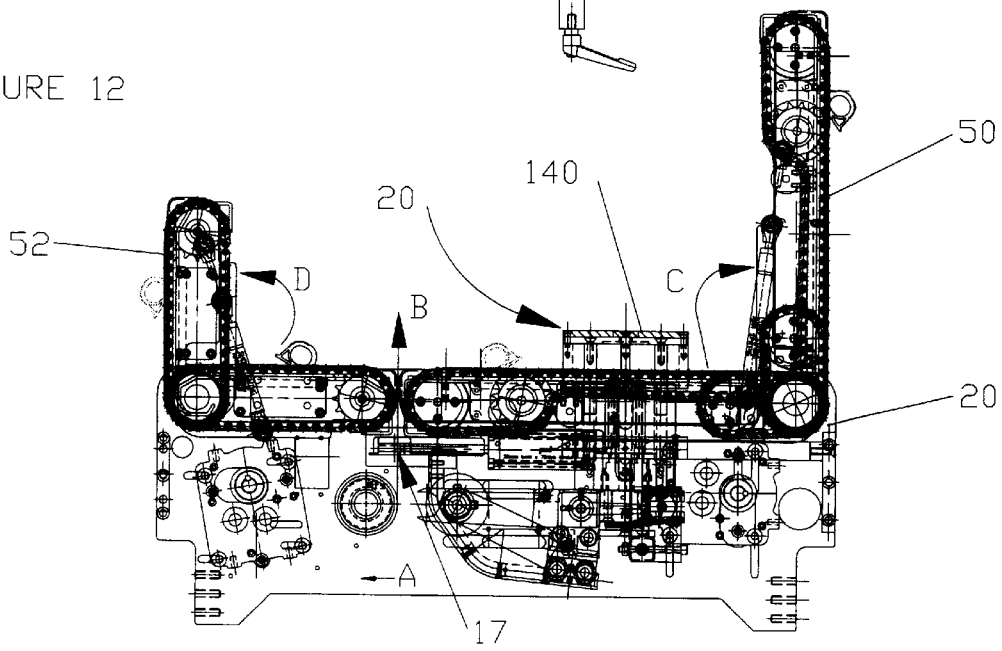
FIG. 12 is a side view of another embodiment of the apparatus in cross-section, with an integrated bundle turner.
Figure 13B:
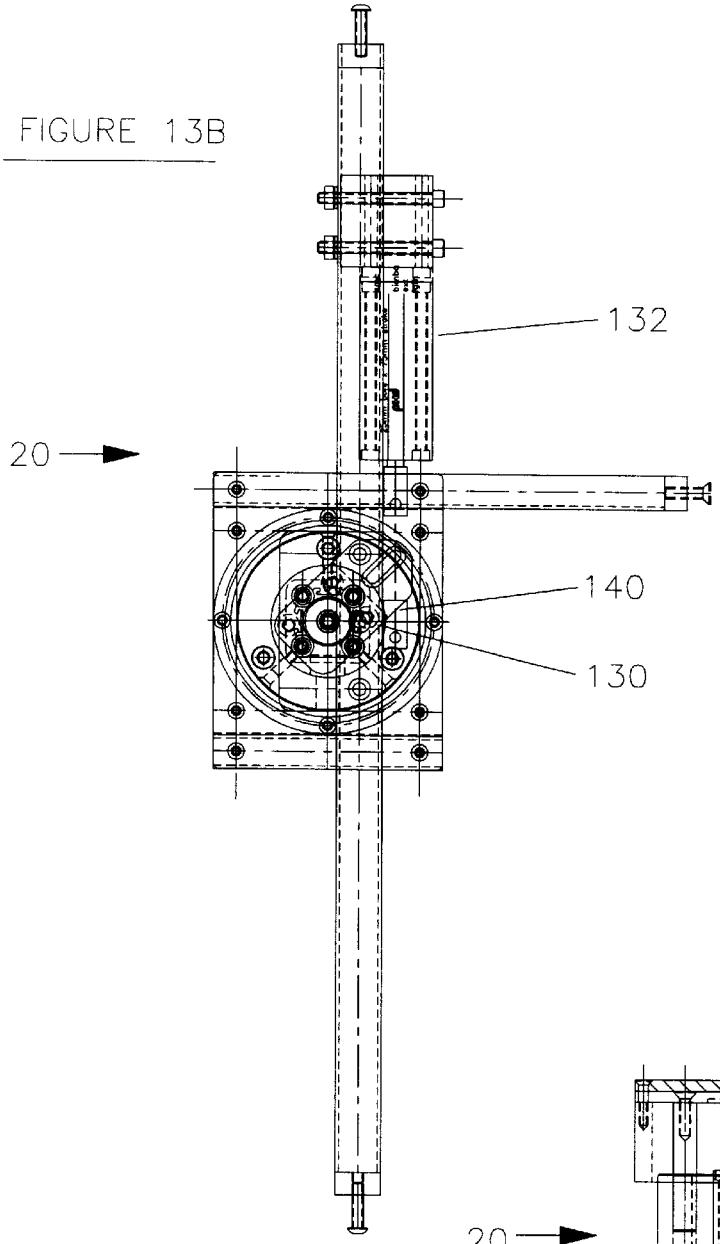
FIG. 13B is a top view detail of the bundle turner.
Figure 13A:
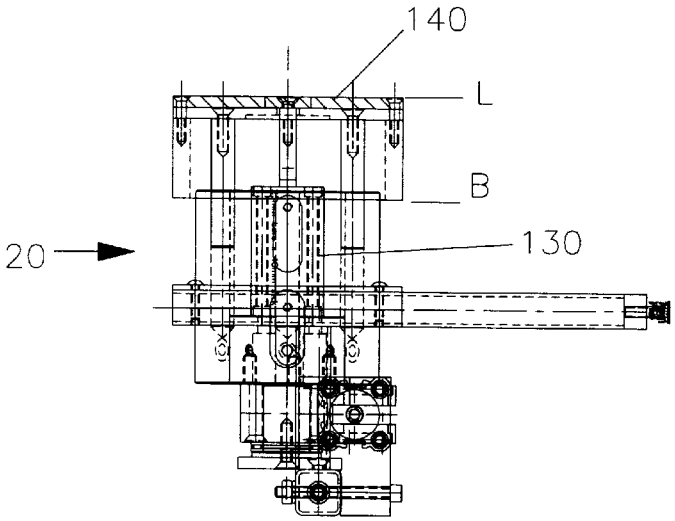
FIG. 13A is a side view detail of the bundle turner.

As described above, the long swing arm conveyor 50 moves the bundle through the first section of the apparatus 10. This conveyor 50 is modified by altering the slider bed configuration to allow the installation of the bundle turning assembly 20, as best shown in FIGS. 12 and 13.

Bundle lift cylinder 130 lifts the bundle plate 140 from a first position B, at the height of the normal path of travel of the bundle on the conveyor 50 to a selected height L. The bundle turn cylinder 132, when activated, then rotates the bundle plate 140 ninety degrees relative to the original direction of travel of the bundle. Bundle stop cylinders 134, 136, when activated, extend their cylinder rods 138 into the path of travel of the bundle. As the bundle travels along the long swing arm conveyor 50, the bundle encounters the cylinder rods 138, which stops the bundle's forward movement, thus enabling the bundle lift cylinder 130 to lift the bundle.

In operation, when the apparatus 10 is placed into the bundleturner mode, the bundle stop cylinder rods 138 are extended into the path of any moving bundles, prior to any bundles entering the conveyor system 14. Paper is pre-fed, as in the three-way wrap mode described above. As a bundle is sensed by the upstream sensor 55 and stopped by the bundled stop cylinders 134, 136, the lifting cylinder 130 is extended, lifting the bundle plate 140, and thus the bundle, to a selected elevation from the long swing arm conveyor belting 64. At the moment the lift height is reached, the turn cylinder 132 is activated, rotating the bundle plate 140, and thus the bundle, 90 degrees, or perpendicular to the original direction of travel. Once the bundle has been rotated, the lift cylinder 130 is retracted, allowing the bundle to move alone its original path. At that time, the paper dispensing and guide assembly is activated as if the system were in the three-way wrap mode of operation, as above described. The upstream belt 112 isolates the paper from the turning bundle, keeping the bundle corners from swiping the paper from the desired path of operation.

Figure 14A:
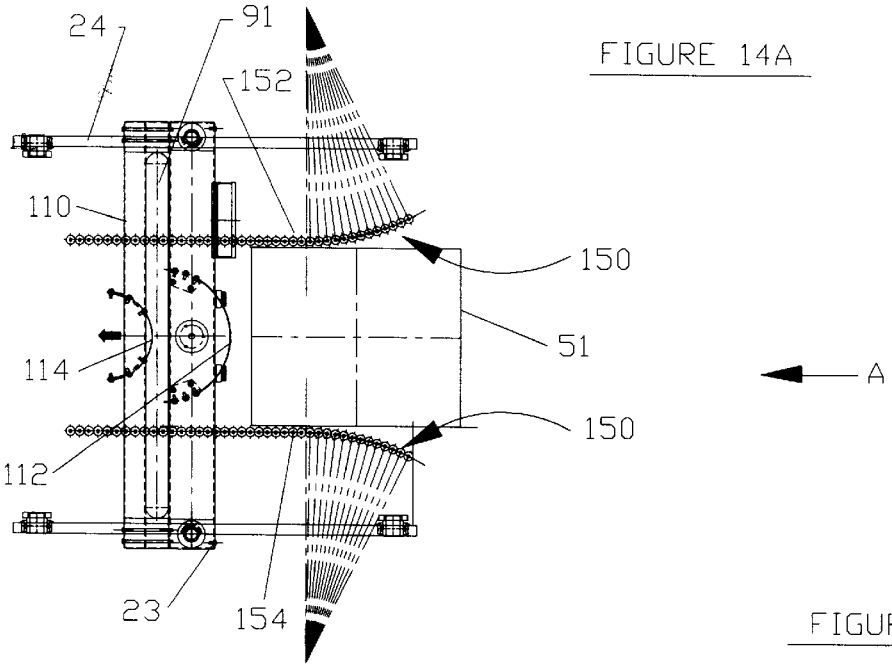
FIG. 14A is a top detail view of the sidewall support assembly.
Figure 14B:
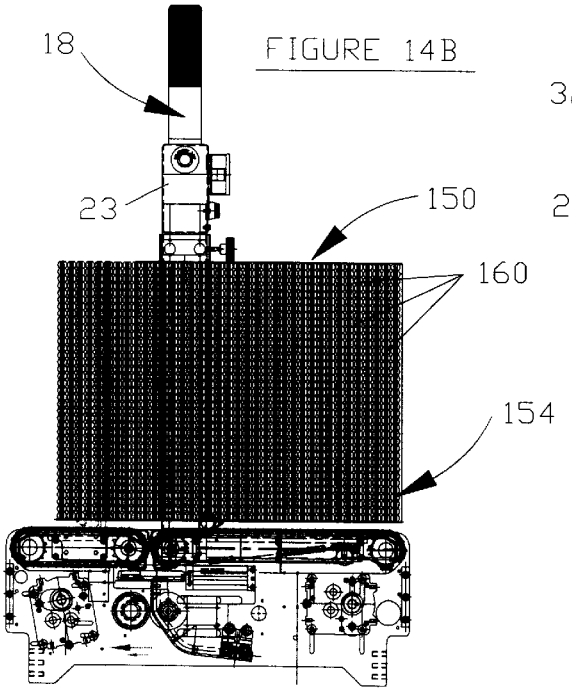
FIG. 14B I is a side view of the sidewall support assembly.
Figure 14:
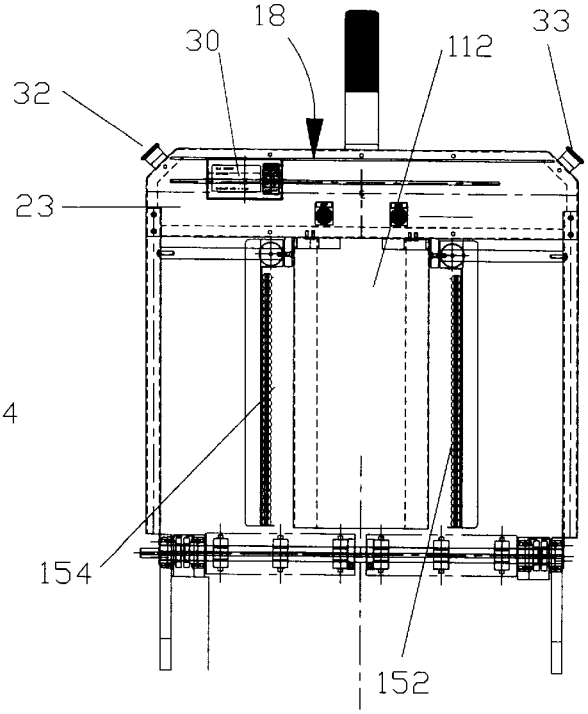
FIG. 14 is a front end view of the apparatus with the sidewall support assembly.

As illustrated in FIGS. 14, 14A and 14B, the apparatus 10 may include a non-motor driven, vertically oriented bundle support sidewall system 150, secured to opposite sides of the conveyor sections 50, 52. Typically, the type of vertically oriented, motor driven conveyor belt or vertically oriented, motor driven long rollers used in other wrapper devices are driven at speeds equal to the wrapper conveyor surface. Because the energy required to move the vertical belt or rollers is greater than an unstable bundle can deliver, the belt or rollers must be motor driven in those devices. If not motor driven, these systems would cause the bundle to jam against or fold or tear the paper due to the added friction of the bundle.

The bundle support sidewall system 150 of the present invention eliminates these problems by using individual plastic roller beads, similar to "hippie" beads, in two sidewall portions 152, 154. The beads are arranged in a plurality of vertical columns 160, each column mounted on independent shafts, thereby reducing any friction encountered by the bundle if the columns were to move simultaneously. Because the roller columns 160 individually rotate and are made of a low friction material, the roller columns will rotate as needed or at different relative speeds to the passing bundle. The sidewall portions 152, 154 are independently attached for adjustment to accommodate different bundle widths.

Figure 15A:
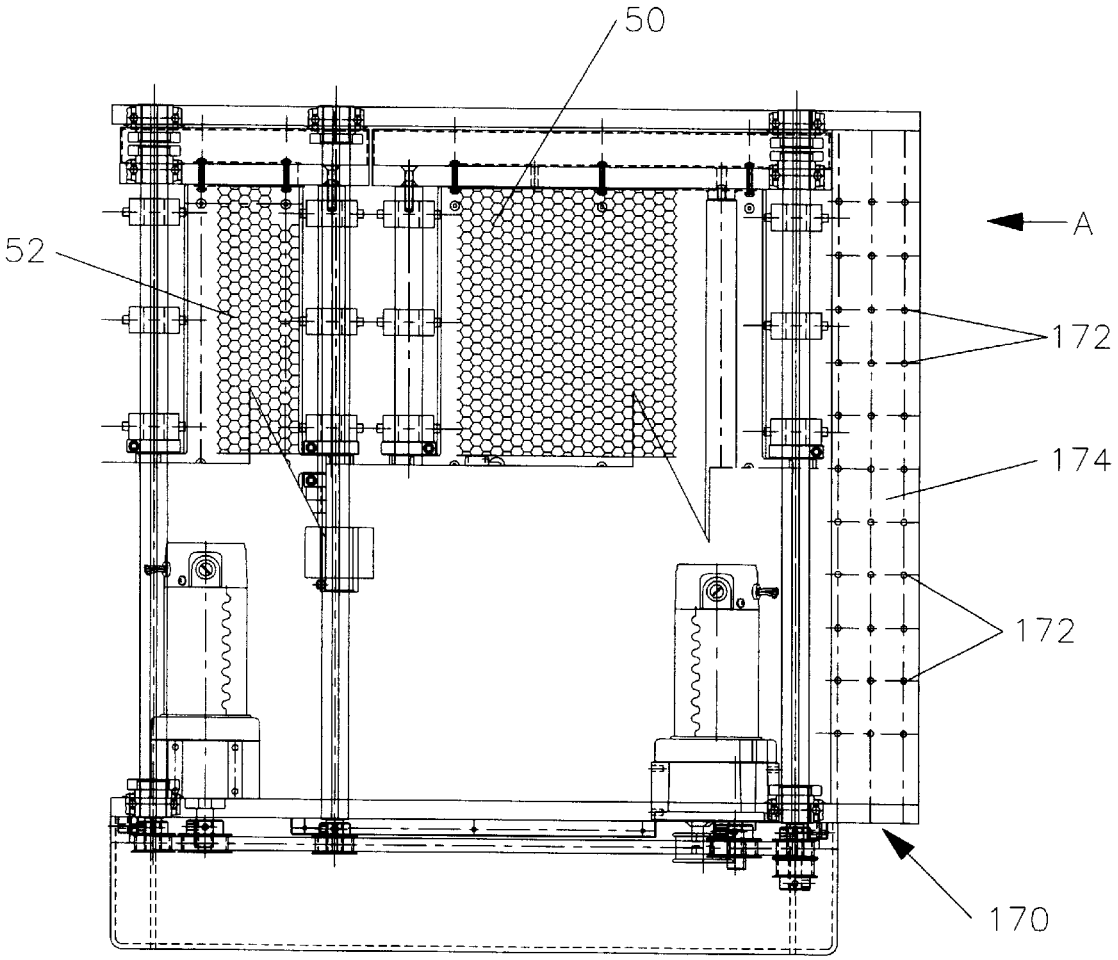
FIG. 15A is a top view of the apparatus with the air table length extension attached.
Figure 15:
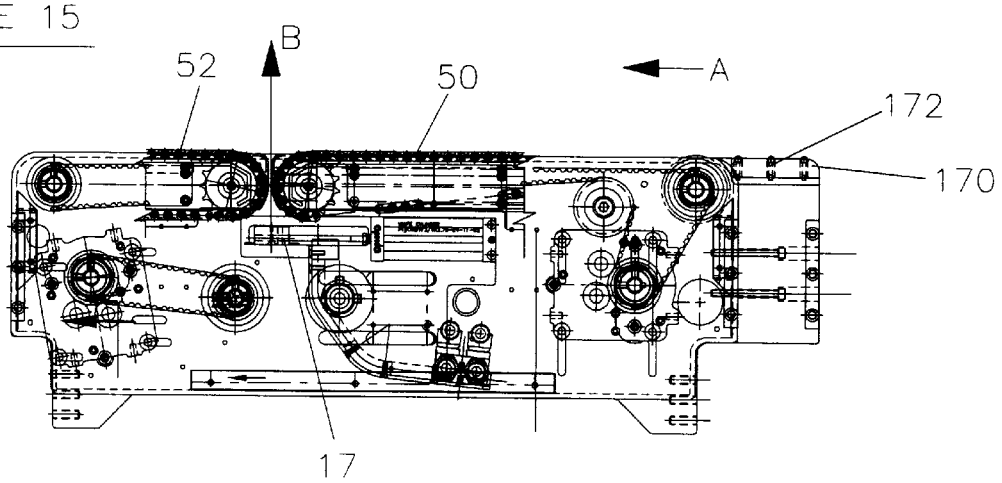
FIG. 15 is a side view of the apparatus employing the air table length extension.

The present invention also contemplates the use of a length extension means 170, preferably an air table device, for adding additional length to the apparatus, illustrated in FIGS. 15 and 15A. Typically, when it is desired to lengthen a bundlewrapping device, an extension is made to the main body structure of the device or by lengthening the conveyor belting. Sometimes conveyor rollers are mounted to the bottomwrapper to extend the length of the bottomwrapper body.

The air table extension device 170, secured to the input end 56 of the apparatus 10 preferably includes a plurality of spring loaded rounded balls 172, although air holes, similar to an air hockey table and a sensor device, could be used to the same effect. Compressed air is channeled beneath the balls 172 and is released by a bundle traveling over the balls 172, pushing them down below the table surface 174. By pushing the balls 172 downward, the seal between the balls 172 and the table 174 is broken, allowing air to be released, thereby forming an air support cushion which reduces the friction between the table surface 174 and the passing bundle. This air pressure under the bundle floats the bundle across the extended length of the wrapper apparatus 10. As soon as the bundle has passed a rounded ball, the spring returns the ball 172 to its original position, thereby preventing the air from being released.

Figure 16A:
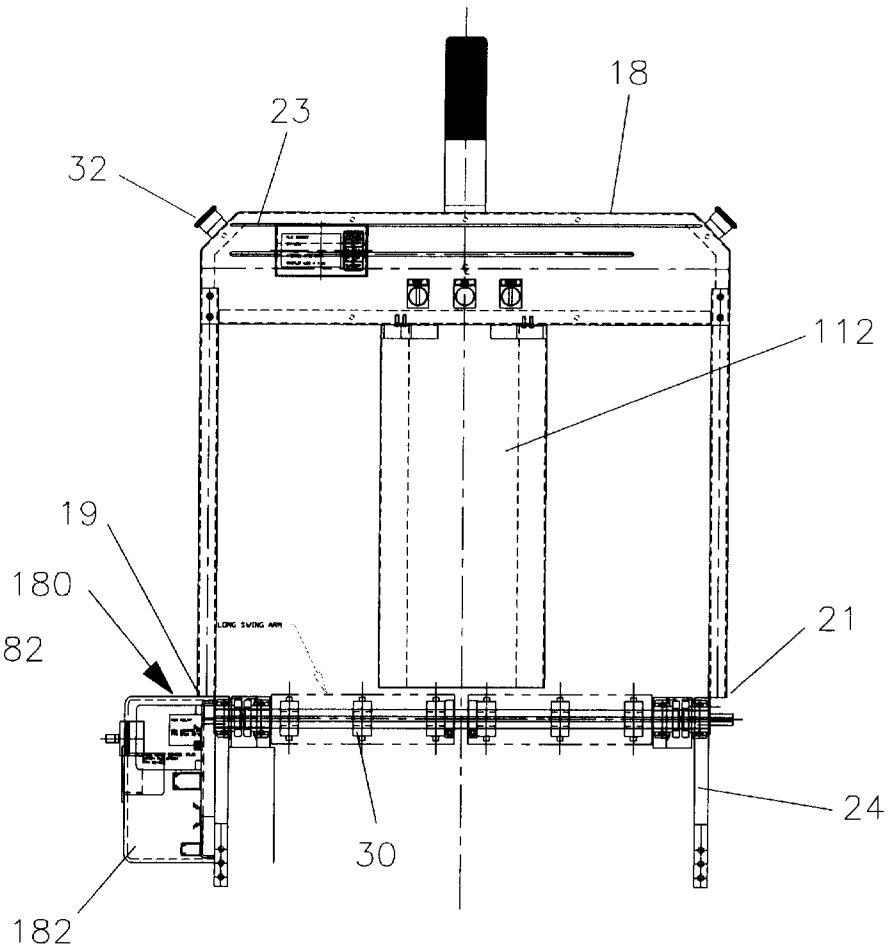
FIG. 16A is an end view of the apparatus illustrating the electrical control panel.
Figure 16:
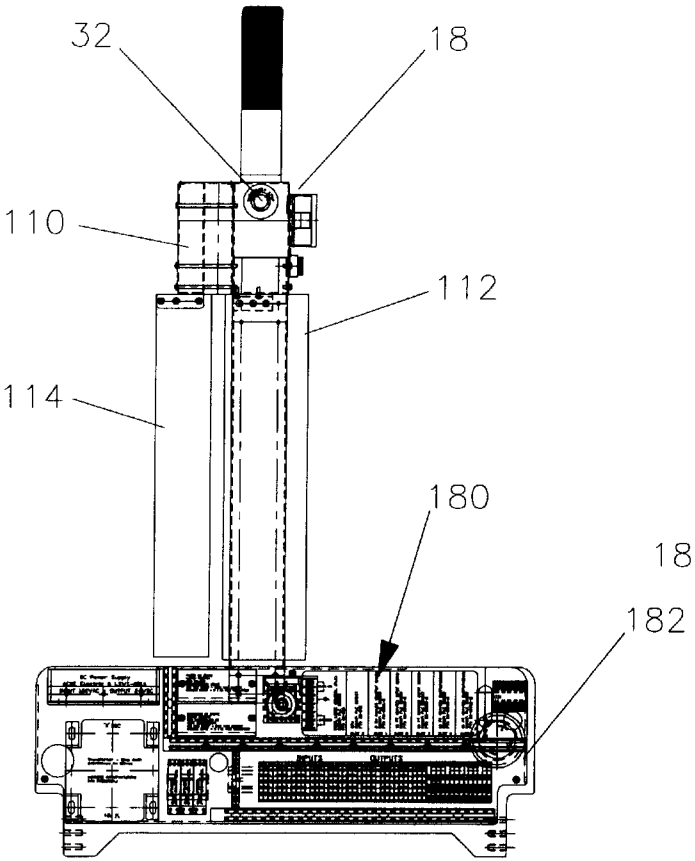
FIG. 16 is a side view of the apparatus, illustrating the electrical control panel.

As implied above with reference to the electrical control tower, the apparatus 10 is electrically powered and includes an electrical control panel 180, as shown in FIGS. 16 and 16A, which comprises a programmable logic controller (PLC) through which all input and output signals are routed. A pair of DC drive controllers drive the paper drive and the conveyor drive independently of one another. The variable speed of the conveyor and paper drive is obtained by utilizing a variable analog output signal from the PLC, rather than by changing mechanical pulleys to alter the speeds, as is done in current wrapper apparatus. The electrical system also includes an electrical step-down transformer, which allows the apparatus 10 to be operated using voltages between 480 vac, 3 ph and 120 vac, 1ph by changing the tap jumpers on the transformer or by bypassing the transformer. No other changes need be made to the apparatus to operate on these other voltages.

It is contemplated that the electrical control panel is covered with a transparent plexiglass or plastic cover 182 to allow the operator to view its functioning.

It is therefore to be understood that while preferred forms of an apparatus and method for wrapping bundles has been herein set forth and described, various modifications and changes may be made in the construction and arrangement of parts and steps, as well as composition of materials without departing from the spirit and scope of the present invention as defined by the appended claims.

I claim:

1. An apparatus for wrapping an article on one or more sides as it moves along a conveyor path, comprising:

first and second conveyor arms for conveying an article along a substantially horizontal path of travel, each of said arms adapted to be pivoted about one end and swung upwardly such that said arm is substantially perpendicular to said horizontal path of travel;

paper dispensing and guide assembly adapted to move a selected length of paper from a paper roll disposed beneath said conveyor arms upwardly between said conveyor arms and into the path of said article, said paper thereby covering said article on at least one side as said article travels into said paper;

a wrapping assembly disposed between said conveyor arms for wrapping said article on at least one side with said dispensed paper, said wrapping assembly including a housing having an elongate chamber adapted to receive an upper margin of said paper therethrough and first and second paper support members arranged to contact said upper margin of said paper on at least two points, thereby maintaining said paper in a substantially vertical orientation relative to said conveyor arms;

a cutting assembly for cutting said selected length of paper from said paper roll after completion of said wrapping process, said cutting assembly including an elongated cutting means having opposite longitudinal ends and a pair of oppositely disposed cutting edges and means for driving said cutting means between first and second positions, said first and second positions disposed on opposite sides of said dispensed paper;

printing means disposed above said cutting assembly; and a turntable assembly for lifting said article to a selected elevation above said conveyor arms and turning said article 90 degrees relative to its path of travel along said conveyor arms.

2. An apparatus according to claim 1 wherein said first conveyor arm is substantially longer than said second conveyor arm.

3. An apparatus according to claim 1 wherein said first conveyor arm moves said article from one end of said apparatus to said wrapping assembly and wherein said second conveyor arms moves said article from said wrapping assembly to a second opposite end of said apparatus.

4. An apparatus according to claim 1 wherein each of said conveyor arms includes conveyor belting comprising a flexible mesh sheet.

5. An apparatus according to claim 1 further comprising an electrical control assembly having generally parallel side arms and a transverse arms joining the upper ends of said side arms, said assembly secured at its lower ends to said apparatus such that said article passes beneath said transverse arm on said conveyor arms, and including a plurality of operator interactive controls thereon.

6. An apparatus according to claim 5 wherein one of said paper support members is attached at its upper end to said transverse arm and the other said paper support member is attached at its upper end to said housing.

7. An apparatus according to claim 1 wherein said paper support members comprise a pair of flexible belts, each of said belts configured to be C-shaped in cross-section.

8. An apparatus according to claim 1 further comprising a printing means mounted above said cutting assembly for printing informational data on said dispensed paper.

9. An apparatus according to claim 1 wherein said paper dispensing and guide assembly comprises first and second roller pairs for driving said paper from said paper roll, a pair of paper guide plates for directing said paper toward said rollers from said roll, at least one paper locking means for preventing additional paper from dispensing from said paper roll, and a cam mechanism for rotational adjustment of said assembly thereby increasing the distance between said guide plate during loading of said paper into said assembly.

10. An apparatus according to claim 1 further comprising first and second electronic sensors for detecting said article moving on said conveyor arms, said first sensor located upstream of said second sensor and adapted to activate said wrapping assembly after detection of said article passing thereby, and said second sensor adapted to activate said paper dispensing and guide assembly after detection of a wrapped article passing thereby.

11. An apparatus according to claim 1 further comprising a sidewall support assembly for vertically supporting said article during its movement along said conveyor arms, said sidewall support assembly comprising a pair of sidewall panels, each said panel comprising a plurality of vertical beaded columns, each said column independently rotatable about a vertical axis by movement of said passing bundle.

12. An apparatus according to claim 1 further comprising length extension means for lengthening said apparatus, said means comprising an air table secured to one end of said apparatus.

13. An apparatus according to claim 1 further comprising an electrical control panel having a transparent cover for viewing the operations of said panel by an operator of said apparatus.

14. An apparatus according to claim 1 wherein said cutting assembly further comprises means for driving said cutting means between first and second positions, said first and second positions disposed on opposite sides of said web, said drive means attached to said longitudinal ends of said cutting means; at least one support arm adapted to support said web in an upright position between said first and second positions, said support arm including a plurality of fingers extending outwardly therefrom for contact with said web, said support arm secured to said wrapping apparatus and disposed above said cutting means; and a plurality of slots disposed in said cutting means and adapted to receive said fingers during action of said cutting means.

15. An apparatus according to claim 1 further comprising a portable frame assembly onto which said apparatus is mounted, said frame including an integrated roll cart for assisting in loading of said paper roll, said roll cart having a gull-wing configured frame and a pair of rollers whereby said frame and roll cart assembly is readily transportable.

16. An apparatus according to claim 15 wherein said frame assembly further comprises integral means for preventing movement of said frame assembly.

17. An apparatus for wrapping an article on one or more sides as it moves along a conveyor path, comprising:

first and second conveyor arms for conveying an article along a substantially horizontal path of travel, each of said arms adapted to be pivoted about one end and swung upwardly such that said arm is substantially perpendicular to said horizontal path of travel;

paper dispensing and guide assembly adapted to move a selected length of paper from a paper roll disposed beneath said conveyor arms upwardly between said conveyor arms and into the path of said article, said paper thereby covering said article on at least one side as said article travels into said paper;

a wrapping assembly disposed between said conveyor arms for wrapping said article on at least one side with said dispensed paper;

a reciprocating cutting assembly for shearing said selected length of paper from said paper roll after completion of said wrapping process; and a turntable assembly within one of said conveyor arms adapted to lift said article at a selected elevation above said conveyor arm and turn said article 90 degrees relative to the path of travel of said article.

18. An apparatus according to claim 17 wherein said wrapping assembly includes a housing having an elongate chamber adapted to receive an upper margin of said paper therethrough and first and second paper support members arranged to contact said upper margin of said paper on at least two selected points, thereby maintaining said paper in a substantially vertical orientation relative to said conveyor arms.

19. An apparatus according to claim 17 wherein said cutting assembly comprises an elongated cutting means having opposite longitudinal ends and a pair of oppositely disposed cutting edges and means for driving said cutting means between first and second positions, said first and second positions disposed on opposite sides of said dispensed paper.

20. An apparatus according to claim 17 further comprising a frame assembly adapted to support said apparatus, said frame assembly including means for readily transporting said frame assembly, integral means for preventing movement of said frame assembly, and means for supporting a paper roll such that paper is readily dispensable from said roll, said frame assembly further comprising an integrated paper roll cart for assisting in loading the paper roll onto said paper roll support means.

21. An apparatus according to claim 17 further comprising an electrical control assembly having generally parallel side arms and a transverse arm joining the upper ends of said side arms, said assembly secured at its lower ends to said apparatus such that said article passes beneath said transverse arm on said conveyor arms, and including a plurality of operator interactive controls thereon.

22. An apparatus according to claim 17 further comprising a sidewall support assembly for vertically supporting said article during its movement along said conveyor arms, said sidewall support assembly comprising a pair of sidewall panels, each said panel comprising a plurality of vertical beaded columns, each said column independently rotatable about a vertical axis by movement of said passing article.

23. An apparatus according to claim 17 further comprising a printing means including a plurality of ink jet heads for printing data on one side of said dispensed paper, said printing means disposed above said cutting assembly.

24. An apparatus according to claim 18 wherein said paper support members are generally C-shaped in cross section, one of said paper support members disposed downstream of the other paper support member in the article's path of travel upon the conveyor arms.

25. A method for wrapping an article on three sides, comprising:

placing the article at the input end of a bundlewrapping apparatus;

conveying the article in a selected direction toward a wrapping means;

dispensing wrapping material in a direction substantially perpendicular to the path of travel of the article;

guiding the wrapping material in a direction substantially perpendicular to the path of the article so as to allow the article to be wrapped by the material on three sides when the article contacts the material;

maintaining the upper portion of the dispensed wrapping material in perpendicular orientation relative to the path of the article by contacting the upper portion at three points with C-shaped material support means;

cutting the wrapping material with a double-edged reciprocating knife;

and electronically sequencing the timing of the wrap dispensing article conveyance, cutting, and wrap guiding steps.

* * * * *